US006807776B2

(12) United States Patent
Girdwood et al.

(10) Patent No.: US 6,807,776 B2
(45) Date of Patent: Oct. 26, 2004

(54) BUILDING OUTFITTING SYSTEM WITH COMMON ACCESSORY-MOUNTING FEATURE

(75) Inventors: Daniel L. Girdwood, East Grand Rapids, MI (US); James N. Ludwig, East Grand Rapids, MI (US); Karl J. Mead, East Grand Rapids, MI (US); Karl H. Mueller, East Grand Rapids, MI (US); Dale T. Kelley, Middleville, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 10/113,124

(22) Filed: Mar. 29, 2002

(65) Prior Publication Data

US 2003/0182871 A1 Oct. 2, 2003

(Under 37 CFR 1.47)

(51) Int. Cl.[7] ..... A47F 10/00

(52) U.S. Cl. ..... 52/36.1; 52/36.4; 52/36.5; 52/220.7; 52/239; 160/371; 160/130

(58) Field of Search ..... 52/36.1, 220.7, 52/239, 36.4, 36.85, 240, 241, 242, 243, 243.1, 36.2, 36.35, 36.6, 37, 38, 39, 79.1–79.14, 27–40; 160/371–381, 405, 130; 108/50.11, 51.11, FOR 100, 153.1–158.13, 59, 60, 90, 91; 240/243.1

(56) References Cited

U.S. PATENT DOCUMENTS

| | | | |
|---|---|---|---|
| 1,908,270 | A | 5/1933 | Shaffer |
| 3,034,609 | A | 5/1962 | Young |
| 3,195,698 | A | 7/1965 | Codrea |

(List continued on next page.)

FOREIGN PATENT DOCUMENTS

| | | |
|---|---|---|
| DE | 2848929 | 5/1980 |
| FR | 2461140 | 7/1979 |

OTHER PUBLICATIONS

Exhibit A discloses a product catalog entitled "80/20 The Industrial Erector Set", published by 80/20 Inc., Columbia City, Indiana, disclosing a modular system using slotted beams for connections.

Exhibit A Discloses a partition–attached utility–distributing module, designed and publicly shown prior to the filing date of the present application, under the tradename SWITCH by SMED Company, which is wholly owned by Haworth, Inc., Holland, MI (12 pages).

Exhibit B Discloses a partition–attached utility–distributing module, designed and publicly shown prior to the filing date of the present application, under the tradename SWITCH by SMED Company, which is wholly owned by Haworth, Inc., Holland, MI (15 pages).

*Primary Examiner*—Jeanette E Chapman
(74) *Attorney, Agent, or Firm*—Price, Heneveld, Cooper, DeWitt & Litton, LLP

(57) ABSTRACT

A prefabricated system for outfitting a building space includes an architectural product (such as a full-height permanent building wall, a post-and-beam product with overhead frame, and a drywall-covered wall), a furniture product (such as a partial-height wall, a partition, and a desking system), and a plurality of accessories. The architectural product includes a structural member with horizontal and vertical accessory-mounting T-slots, and the furniture product includes structural trim pieces with identical vertical and horizontal accessory-mounting T-slots. The plurality of accessories are constructed to stably engage any of the accessory-mounting slots at a selected location along the slots. Some accessories can be attached to and extend between the two products, such as an accessory screen that extends between a post of a post-and-beam system and an end of a partition system.

95 Claims, 16 Drawing Sheets

U.S. PATENT DOCUMENTS 3,261,625 A 7/1966 Cripe
3,305,981 A 2/1967 Biggs et al.
3,312,025 A 4/1967 Deakins
3,517,467 A 6/1970 Propst et al.
3,730,477 A 5/1973 Wavrunek
3,733,759 A 5/1973 Schulte et al.
3,766,696 A 10/1973 Totoonchie
3,778,175 A 12/1973 Zimmer
3,778,939 A 12/1973 Nelsson
3,807,102 A 4/1974 Albinson et al.
3,828,495 A 8/1974 Law
3,849,962 A 11/1974 Albinson et al.
RE28,408 E 5/1975 Nelsson
3,901,612 A 8/1975 Canin
3,982,370 A 9/1976 Buffington
4,030,260 A 6/1977 Sukolics et al.
4,035,972 A 7/1977 Timmons
4,073,113 A 2/1978 Oudot et al.
4,109,429 A 8/1978 Whisson
4,192,106 A 3/1980 Hell
4,269,005 A 5/1981 Timmons
4,360,240 A 11/1982 Koncelik et al.
4,366,999 A 1/1983 Koncelik et al.
4,416,093 A 11/1983 Salkeld et al.
4,433,630 A 2/1984 Laborie
4,434,900 A 3/1984 Cook
4,441,300 A 4/1984 Varon et al.
4,443,979 A 4/1984 Varon et al.
4,448,003 A 5/1984 Hasbrouck
4,450,655 A 5/1984 Rosenthal et al.
4,513,557 A 4/1985 Wendt
4,535,525 A 8/1985 Varon et al.
4,560,130 A 12/1985 Schwartz
4,567,698 A 2/1986 Morrison
4,571,906 A 2/1986 Ashton
4,581,859 A 4/1986 Doke et al.
4,589,235 A * 5/1986 Anderson ..... 52/28
4,611,448 A 9/1986 DeLong
4,631,881 A 12/1986 Charman
4,677,794 A 7/1987 Parron et al.
4,684,425 A 8/1987 Bannister
4,719,731 A 1/1988 Ravotti et al.
4,787,767 A 11/1988 Wendt
4,841,699 A 6/1989 Wilson et al.
4,860,812 A 8/1989 DePietro et al.
4,891,922 A 1/1990 Hozer et al.
4,893,446 A 1/1990 Gudmundsson et al.
4,903,452 A 2/1990 Huang
4,947,601 A 8/1990 McGuire
4,949,519 A 8/1990 Jeffers
D314,482 S 2/1991 Walter et al.
5,025,603 A 6/1991 Johnson
5,056,577 A 10/1991 DeLong et al.
5,069,263 A 12/1991 Edwards
5,070,666 A 12/1991 Looman
5,086,606 A 2/1992 Finses
5,088,541 A 2/1992 Persing et al.
5,101,606 A 4/1992 Meru
5,125,193 A 6/1992 Beaulieu
5,125,197 A 6/1992 Fuchs
5,134,826 A 8/1992 LaRoche et al.
5,155,960 A 10/1992 Shaanan
5,175,969 A 1/1993 Knauf et al.
5,184,441 A 2/1993 Balfanz, Jr.
5,189,850 A 3/1993 Felton
5,247,773 A 9/1993 Weir
5,274,970 A 1/1994 Roberts
5,277,512 A 1/1994 Dwillies
5,287,666 A 2/1994 Frascaroli et al.
5,339,576 A 8/1994 Fussler
5,341,615 A 8/1994 Hodges et al.
5,347,778 A 9/1994 Bray
5,377,466 A 1/1995 Insalaco et al.
5,394,658 A * 3/1995 Schreiner et al. ..... 52/36.1
5,394,668 A 3/1995 Lim
5,406,760 A 4/1995 Edwards
5,430,984 A 7/1995 Young et al.
5,433,046 A 7/1995 MacQuarrie et al.
5,474,402 A 12/1995 Wu
5,479,747 A 1/1996 Wu
5,524,394 A 6/1996 Szabo, Sr. et al.
5,560,169 A 10/1996 Palmer
5,600,926 A 2/1997 Ehrlich
5,634,300 A 6/1997 Huebner et al.
5,638,650 A 6/1997 Edwards
5,642,593 A 7/1997 Shieh
5,689,924 A 11/1997 Mason
5,724,779 A 3/1998 Chang
5,737,893 A 4/1998 Rossiter et al.
5,758,466 A 6/1998 Tucker
5,803,146 A 9/1998 Boon
5,816,001 A 10/1998 Goodman et al.
5,826,639 A 10/1998 Miller
5,831,211 A 11/1998 Gartung et al.
5,839,240 A 11/1998 Elsholz et al.
5,852,904 A 12/1998 Yu et al.
5,875,594 A 3/1999 Hellwig et al.
5,875,596 A 3/1999 Muller
5,899,035 A 5/1999 Waalkes et al.
5,901,523 A 5/1999 Tasi
5,934,623 A 8/1999 Kopish
5,939,240 A 8/1999 Kobayashi
5,950,371 A 9/1999 Rives et al.
5,960,599 A 10/1999 Schmidt et al.
5,970,662 A * 10/1999 Corcorran et al. ..... 52/36.1
5,970,675 A 10/1999 Schray
5,974,742 A * 11/1999 Schreiner et al. ..... 52/36.1
5,979,118 A * 11/1999 Gortsema et al. ..... 52/36.1
6,003,275 A 12/1999 Cornell et al.
6,052,958 A 4/2000 Miedema et al.
6,073,399 A 6/2000 Shipman et al.
6,098,358 A 8/2000 Waalkes et al.
6,112,472 A * 9/2000 Van Dyk et al. ..... 52/36.1
6,112,485 A 9/2000 Beyer et al.
6,128,877 A 10/2000 Goodman et al.
6,167,664 B1 1/2001 Reuter et al.
6,202,381 B1 3/2001 Dame et al.
6,223,485 B1 5/2001 Beck et al.
6,230,459 B1 5/2001 Jeffers et al.
6,244,002 B1 6/2001 Martin
6,250,020 B1 * 6/2001 Shipman ..... 52/36.1
6,250,032 B1 6/2001 Davis et al.
6,260,324 B1 7/2001 Miedema et al.
6,276,103 B1 8/2001 Waalkes et al.
6,279,278 B1 8/2001 Morris et al.
6,282,854 B1 9/2001 Vos et al.
6,295,764 B1 10/2001 Berridge et al.
6,301,846 B1 10/2001 Waalkes et al.
6,314,687 B1 11/2001 Schondelmayer et al.
6,330,773 B1 12/2001 MacDonald et al.
6,367,213 B1 4/2002 Reuter et al.
6,374,548 B1 4/2002 Ruedinger et al.
6,378,255 B1 * 4/2002 Eich et al. ..... 52/220.7

* cited by examiner

BUILDING OUTFITTING SYSTEM WITH COMMON ACCESSORY-MOUNTING FEATURE

BACKGROUND

The present invention relates to prefabricated systems for outfitting a building space, where architectural and furniture systems are constructed to utilize selectable accessories. Architectural systems are systems that are typically considered to be building fixtures and the like attached to the building, and that "look and feel" like permanent building structures. For example, in this application, the term "architectural systems" include items such as outer walls, an outer-wall-covering system, an interior-wall-covering system, an interior-wall-forming system, a post-and-beam overhead-frame system, a building-column-covering system, a raised floor system, a drop ceiling system, and an overhead utility-carrying bulkhead system. Contrastingly, furniture systems are systems that a user directly touches and engages and interacts with while doing their job. Furniture systems are characteristically rearrangeable and re-configurable and less permanently attached to a building structure such that they can be more easily removed. For example, in this application, the term "furniture systems" include items such as a full-height partition system, a partial-height partition system, a partition-attached furniture system, a free-standing furniture system, a cabinet/storage system, and the like. The accessories include items such as shelves, lighting, teaming accessories (such as marker boards, electronic products, material storage products, and work surfaces), space-separating devices (such as privacy screens, hanging panels), personal and customizing products, material-handling accessories, signage, storage products, electronic individual devices (such as telephones, CD players, palm-top and hand-held devices, and recharging devices), and the like.

Prefabricated systems are often used to subdivide and outfit a building space. The advantages are many. Typically, prefabrication lowers cost by taking advantage of mass production. Further, a "better-looking" office results since all of the subsystems are designed to go together visually and are often designed for interconnectability. For example, see the system described in U.S. Pat. No. 5,784,843 (to Greer et al). However, though the overall system is designed to look good together and for maximum interconnectability, each subsystem tends to have its own set of accessories. This can be inefficient, frustrating, and cost-inefficient, since different accessories are required for each subsystem, even when the two accessories are basically for the same purpose. Part of the problem is driven by the fact that each subsystem necessarily has a different frame that presents a different attachment structure to attach to. For example, a freestanding post of a post-and-beam subsystem is very long but has a small horizontal cross-sectional shape limited to a few inches square, while a partition in the partition subsystem has a freestanding frame that is very thin but several feet long and high, while the frame of an architectural wall-covering subsystem is typically very thin and is not free-standing (i.e. it attaches to a building permanent wall). For these reasons and related structural reasons, each subsystem tends to require different bracketry for supporting accessories. It is desirable to provide accessories and an accessory-mounting system that is common between different furniture subsystems, while still maintaining the advantages of each separate system.

Modern offices are becoming smaller and smaller, and there is an increasing effort to optimize use of office space as well as to make maximum use of every bit of available space. Further, business owners have found that it can be very important to allow workers to customize their areas and make the areas their "own", because workers will tend to work harder, have a better attitude, and be more productive. Further, business owners have discovered that different areas may need different furniture systems. For example, team areas may need a more open floor plan and larger accessories suitable for supporting large group activities, while office areas will tend to need isolated private offices optimized for efficient utilization of space and workflow, and for customization, individualization, and privacy. Nonetheless, despite the different needs of different areas, common accessories are desirable. For example, shelves, screening, storage, paper handling, and lighting are often required in all areas.

One area that often causes problems with a common mounting scheme for accessories is trim. Trim, by definition, covers up (or at least substantially covers up) the furniture system to make the furniture "visually clean". This makes it difficult to attach accessories to the underlying framework, since the underlying framework must be accessed through differently oriented slits and crevices, and/or through specially-bored holes. Further, bracketry must be designed to support the weight of an accessory during use, and provide the desired amount of stability to allow comfortable use. The combination of differently oriented slits and crevices, and different shapes of the support structure in various architectural and furniture systems, results in a wide variety of differently shaped brackets, accessories, and assembly schemes. The above problems are complicated by the fact that trim is typically not structural, but instead is a low-cost aesthetic material not able to support significant loads nor able to withstand significant stresses or abrasion during use.

Accordingly, an apparatus is desired solving the aforementioned problems and having the aforementioned advantages.

SUMMARY OF THE PRESENT INVENTION

In one aspect of the present invention, a system for outfitting a building space include an architectural product having a first structural member with a first accessory mount feature, and a furniture product having a second structural member with a second accessory mount feature that is substantially similar to the first accessory mount feature. A plurality of accessories are provided that are each configured to stably engage the first accessory mount feature and also configured to stably engage the second accessory mount feature. In a narrower form, at least one of the plurality of accessories is attached to the first accessory mount feature and at least another one of the plurality of accessories is attached to the second accessory mount feature.

In one narrower aspect, the architectural product includes at least one of a full-height permanent building wall, a post-and-beam product with overhead frame, and a drywall-covered wall. Also in a narrower aspect, the furniture product includes at least one of a partial-height wall, a partition, and a desking system. In yet narrower aspects, the architectural product includes a post-and-beam product with overhead frame, and the furniture product includes a partial-height freestanding partition system.

In another aspect of the present invention, a prefabricated system for outfitting a building space includes an architectural system configured to finish portions of a building space and a partition system constructed and adapted to subdivide the building space for office use. The architectural system includes a first structural member defining at least one longitudinally-extending first accessory-mounting slot with first blind surfaces, and the partition system includes at least one longitudinally-extending second accessory-mounting slot with second blind surfaces. A plurality of accessories each have a base shaped to mateably selectively engage the first blind surfaces of the first accessory-mounting slots and shaped to mateably selectively engage the second blind surfaces of the second accessory-mounting slots, and each include at least one fastener associated with the selected accessory that, when engaged with an associated one of the first and second blind surfaces, is shaped to releasably engage the associated blind surfaces to retain the associated accessory in a selected position along the associated accessory-mounting slot.

In another aspect of the present invention, a system for outfitting a building space includes a post-and-beam system including an overhead framework with beams and a plurality of posts supporting the overhead framework, at least one of the posts and beams including a first accessory-mounting feature in the form of a first elongated slot. The system further includes a partition system having a plurality of interconnected partition panels, the partition panels each including a top surface and end surfaces, with at least one of the top and end surfaces having a second accessory-mounting feature in the form of a second elongated slot. The system also includes a plurality of accessories each configured to matably and stably engage a selected one of the first and second accessory-mounting features to retain the accessory to the selected one mounting feature.

In yet another aspect of the present invention, a method comprises steps of providing an architectural product and a partition product, each having an identical elongated mount feature; and providing a plurality of accessories adapted for mounting to the mount feature. The method further includes selectively attaching at least one of the plurality of accessories to the mount feature on a selected one of the architectural product and the partition product. In a narrower form, the method includes also selectively attaching the one accessory to the other of the architectural product and the partition product, with the selected one accessory extending between the architectural product and the partition product.

These and other aspects, objects, and features of the present invention will be understood and appreciated by those skilled in the art upon studying the following specification, claims, and appended drawings.

Figure 1:
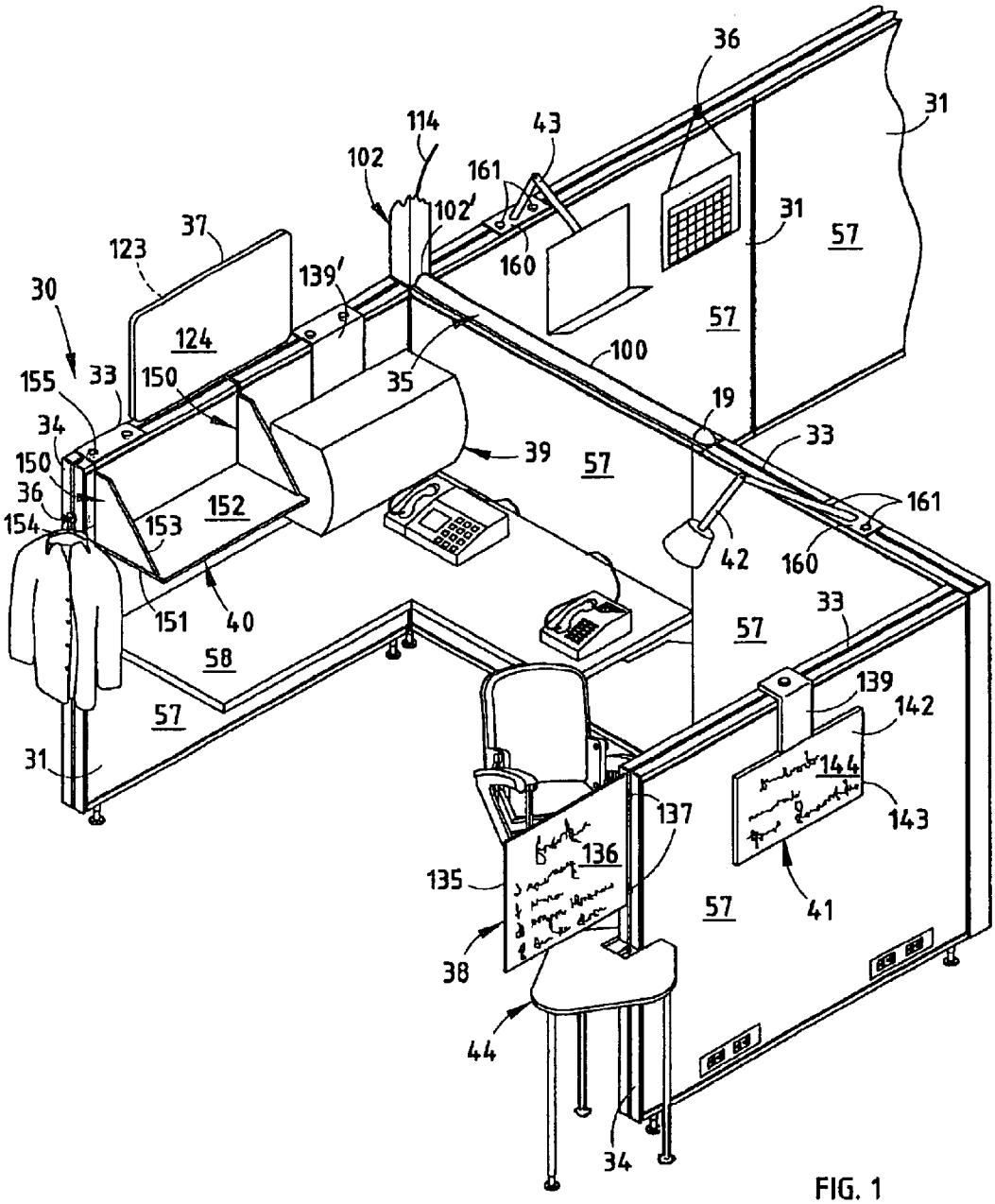
FIG. 1 is a perspective view of an office arrangement including partitions with trim pieces embodying the present invention.
Figure 2:
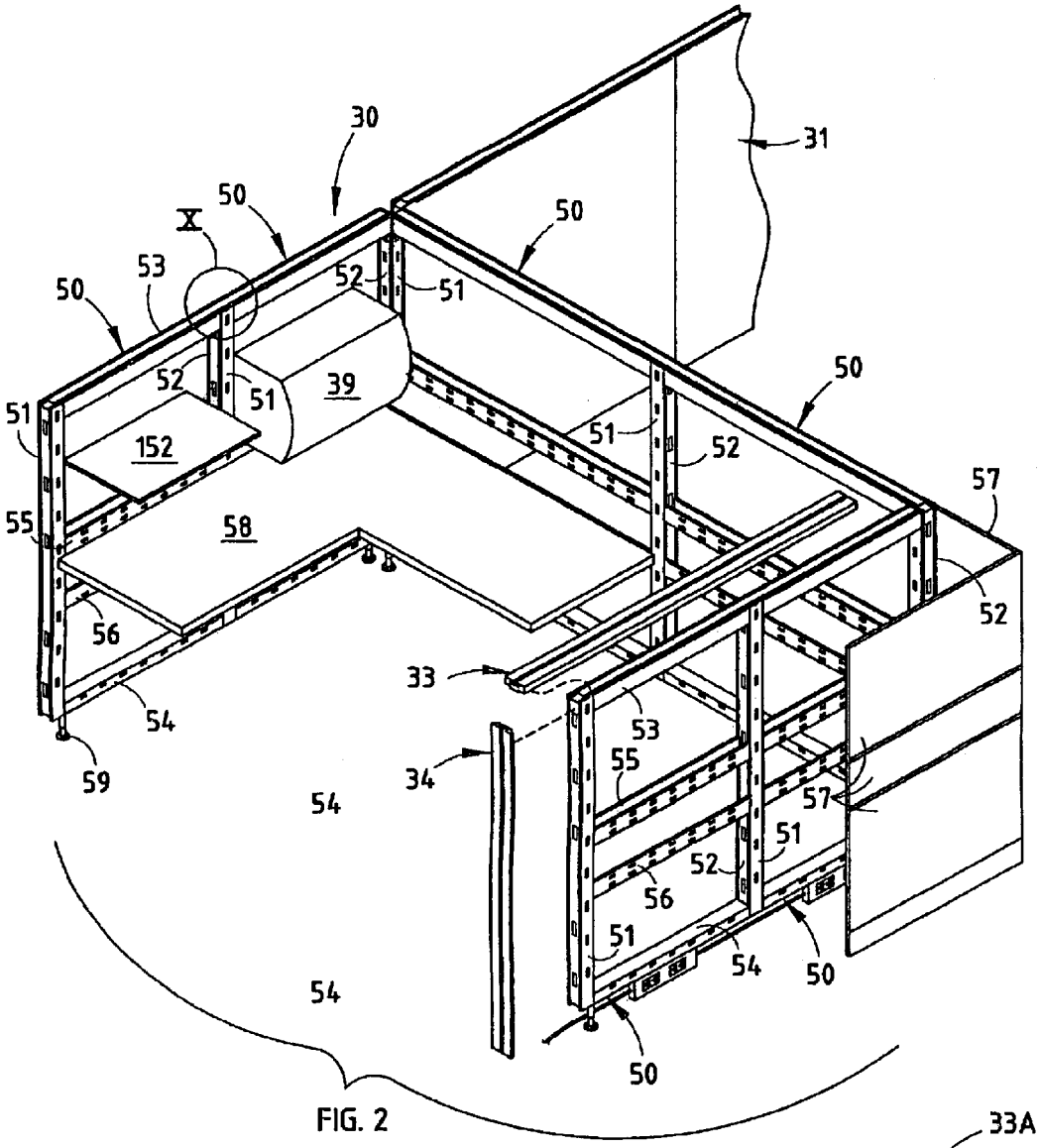
FIG. 2 is a perspective view of the partition frames of FIG. 1, including the top trim piece, end trim piece, and side covers exploded away from the closest one of the partitions.
Figure 3:
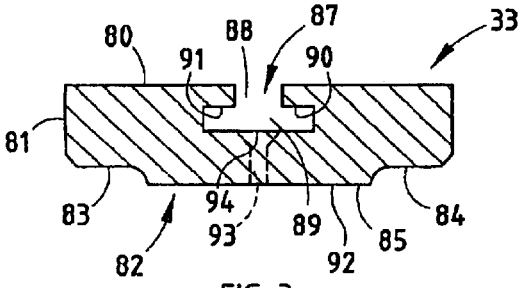
FIG. 3 is a cross section of the trim piece shown in FIG. 2.
Figure 3A:
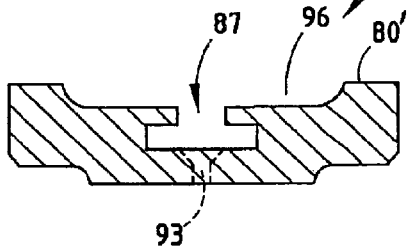
FIG. 3A is a cross section of a modified trim piece similar to FIG. 3 but having a top recess.
Figure 4:
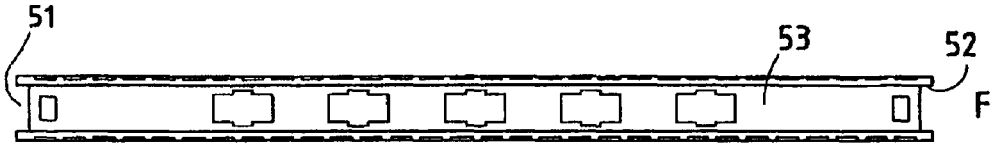
FIGS. 4–7 are top, side, bottom, and end views of a partition frame from FIG. 2.
Figure 5:
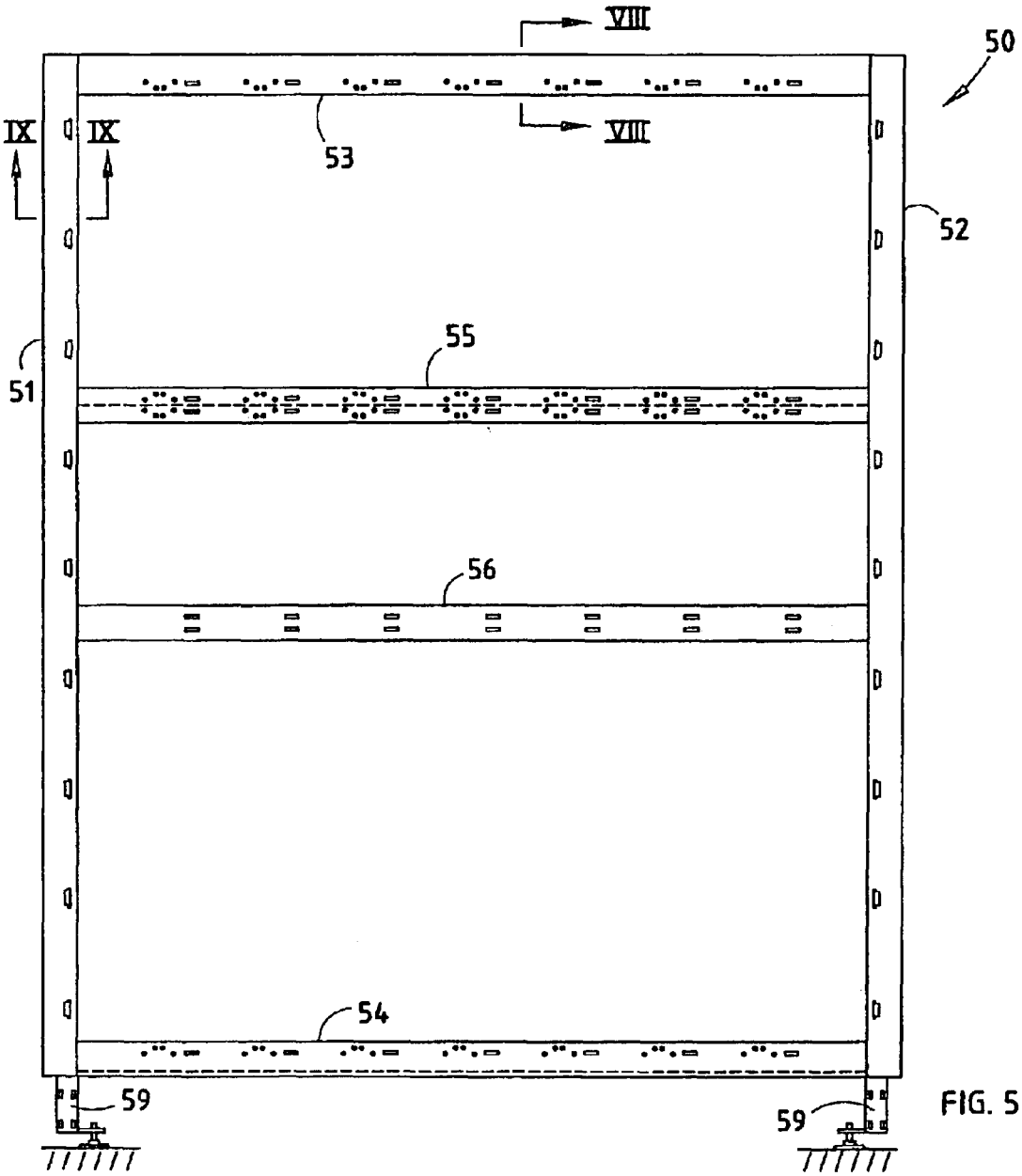
Figure 6:
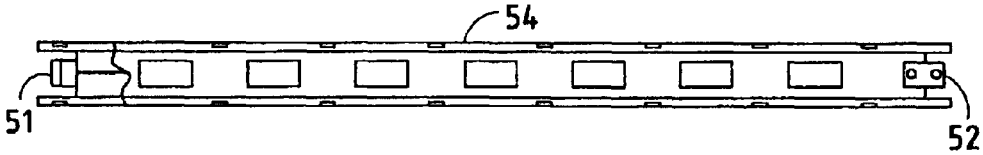
Figure 7:
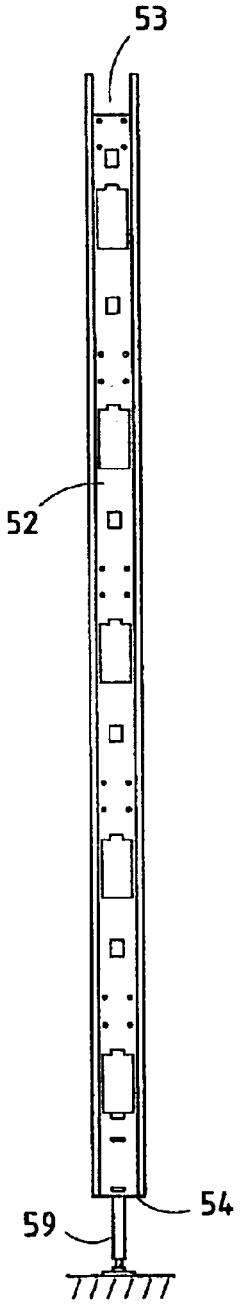
Figure 8:
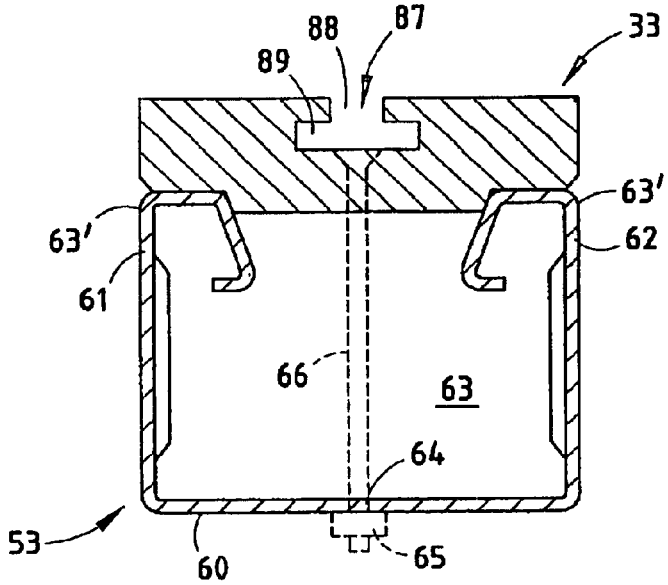
FIGS. 8–9 are cross sections taken along the lines VIII—VIII and IX—IX in FIG. 5.
Figure 17:
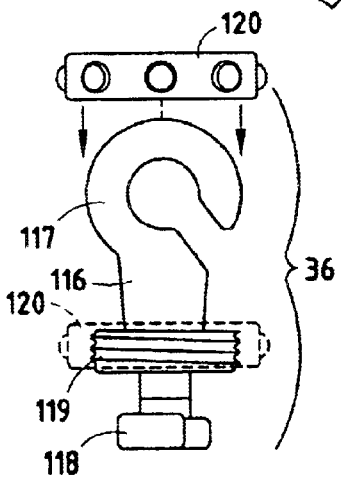
FIGS. 12–16, FIGS. 17–19, FIG. 20, and FIG. 21 show various accessories adapted for engagement with the T-slot of the trim piece of FIG. 1.
Figure 18:
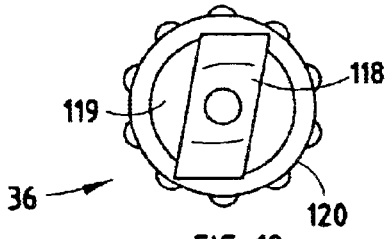
Figure 19:
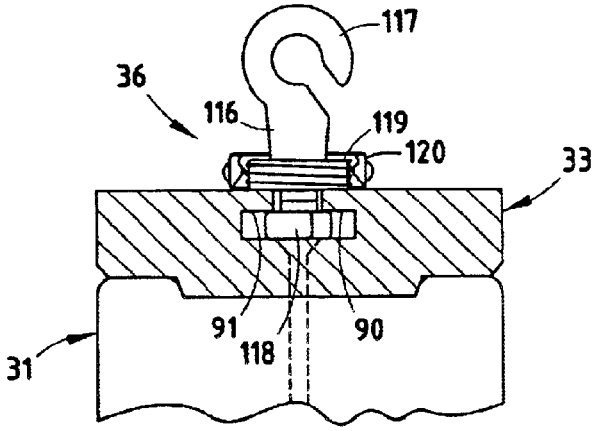
Figure 13:
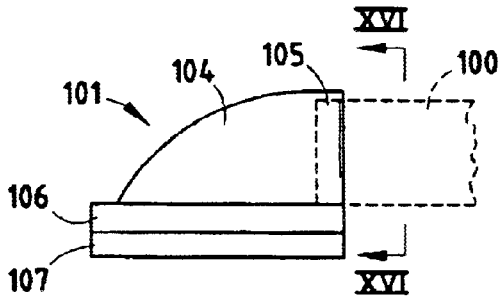
Figure 15:
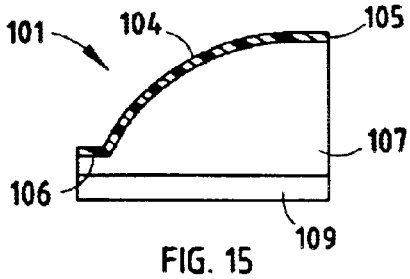
Figure 14:
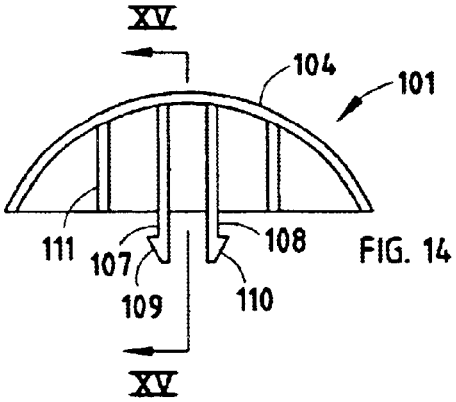
Figure 15A:
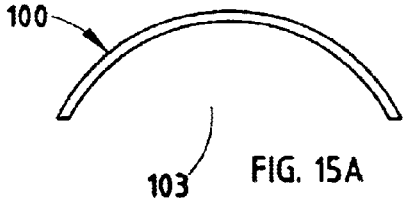
Figure 16:
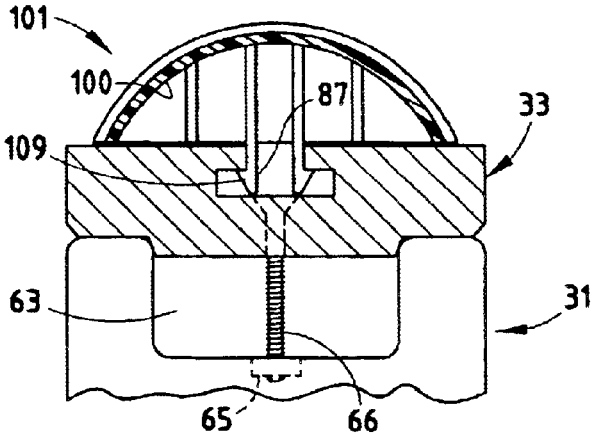
Figure 20:
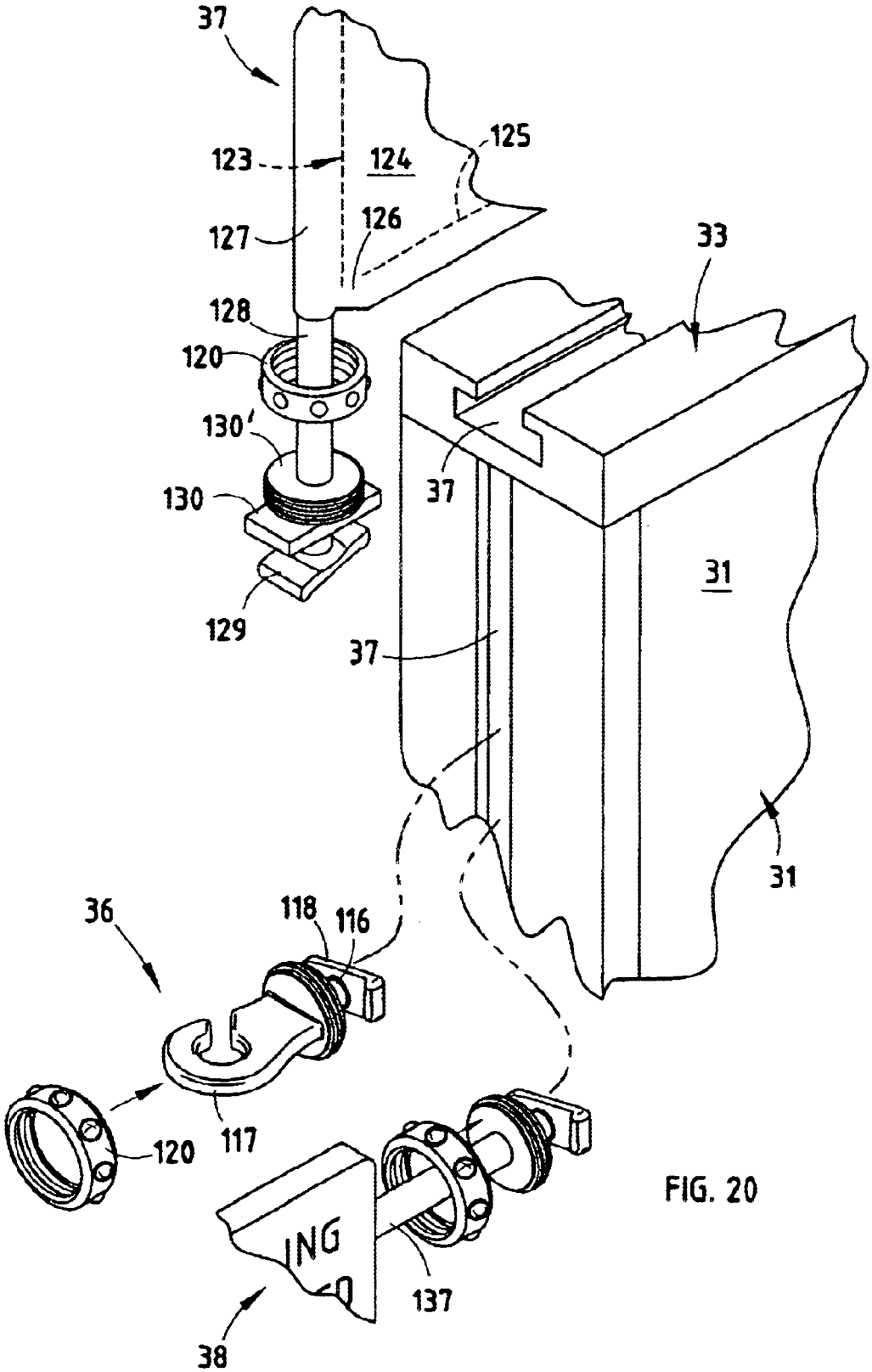
Figure 21:
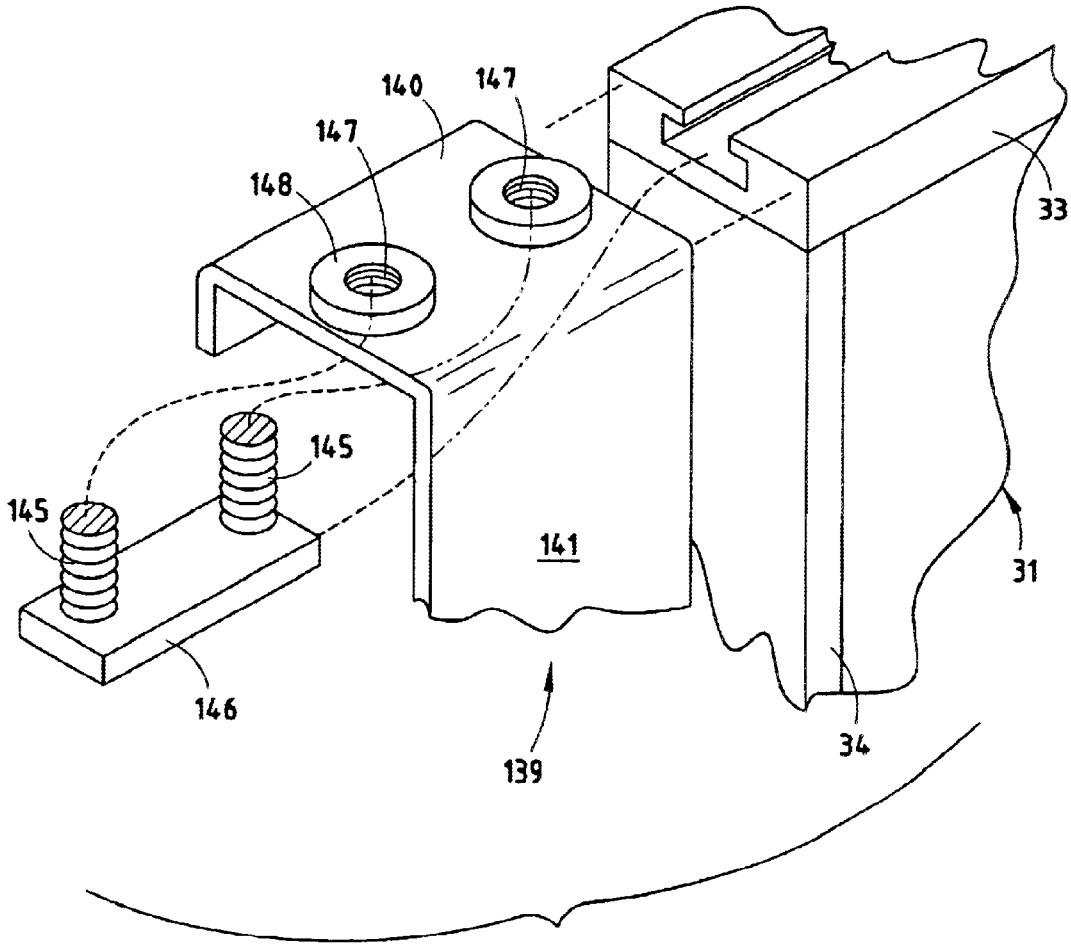

More particularly, in regard to FIGS. 12–21:

FIG. 15 is a cross section taken along the line XV—XV in FIG. 14;

FIG. 15A is an end view of the tunnel-shaped wire manager, which fits into the end piece of the wire manager as shown in FIG. 13 in phantom lines;

FIG. 16 is a cross section taken along the line XVI—XVI in FIG. 13, which shows an inner end of the end piece of the wire manager, and its engagement with the T-slot in the trim piece, and the engagement of the tunnel-shaped wire manager with the end piece;

FIGS. 17–18 are side and bottom views of a hook accessory, with FIG. 19 showing engagement of the hook in the T-slot in the trim piece;

FIG. 20 is a fragmentary perspective view of a partition including a T-slot top trim piece and a T-slot end trim piece, and including a top-of-panel mounted screen and its engagement with the T-slot of a top trim piece, and including a side-mounted hook and its engagement with the T-slot of the end trim piece, and including a side-mounted erasable marker board and its engagement with the T-slot of the end trim piece; and FIG. 21 is a perspective view of an inverted L-bracket adapted for mounting a panel on a face of a partition as shown in FIG. 1, including showing its engagement with a T-slot of a top trim piece.

Figure 22:
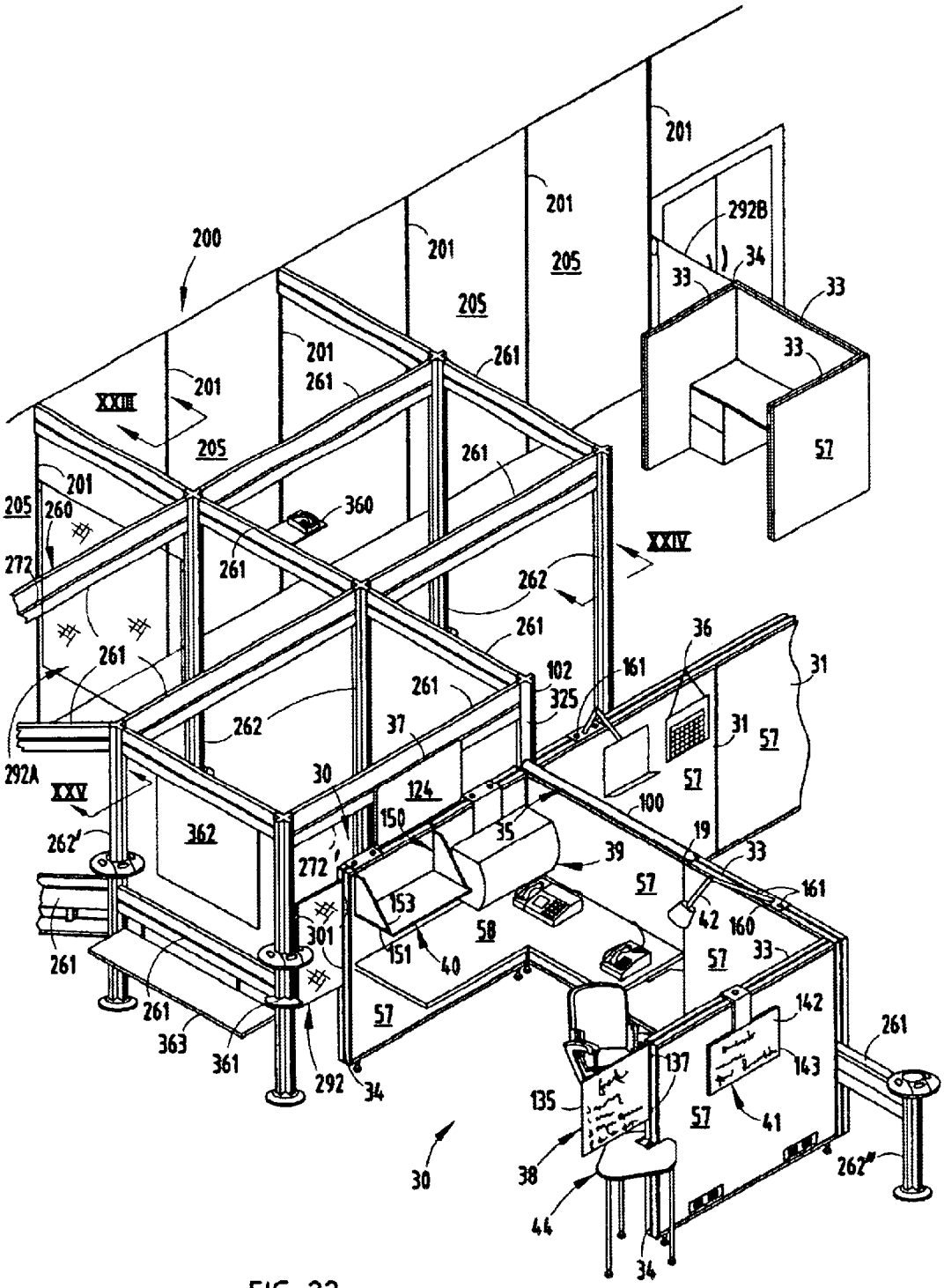
Figure 23:
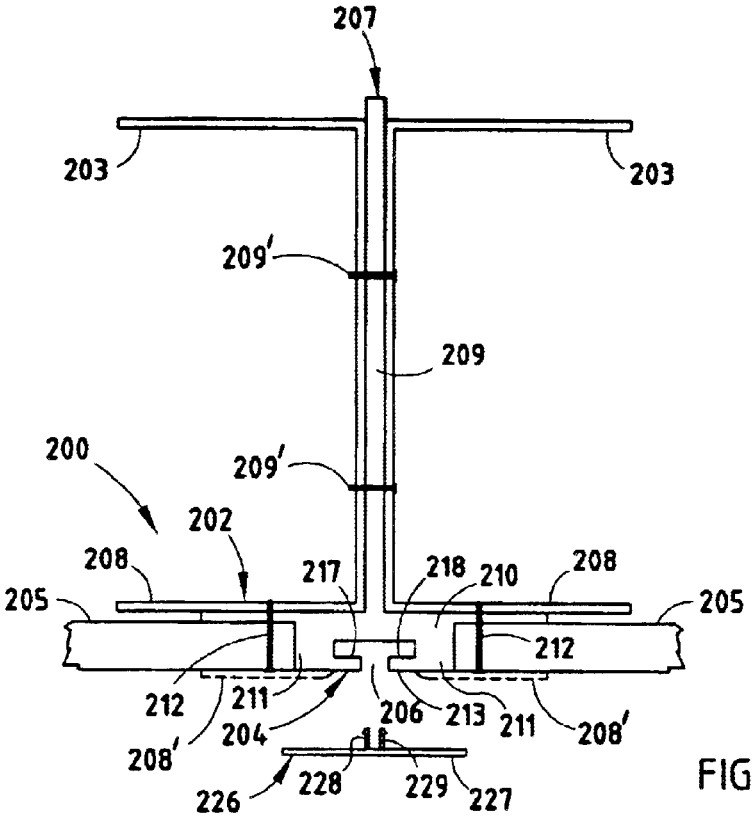
Figure 23A:
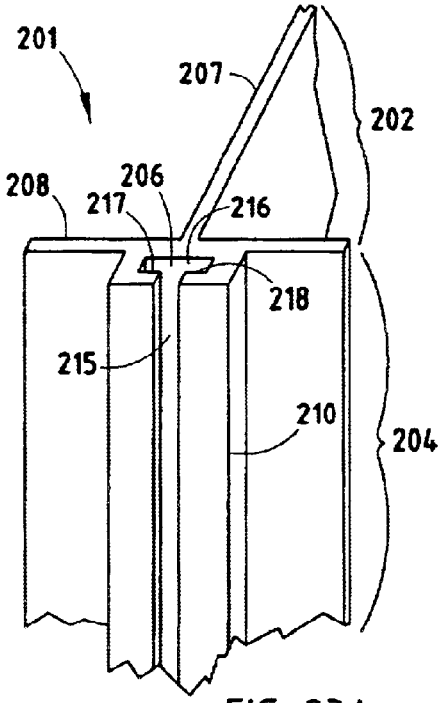
Figure 23B:
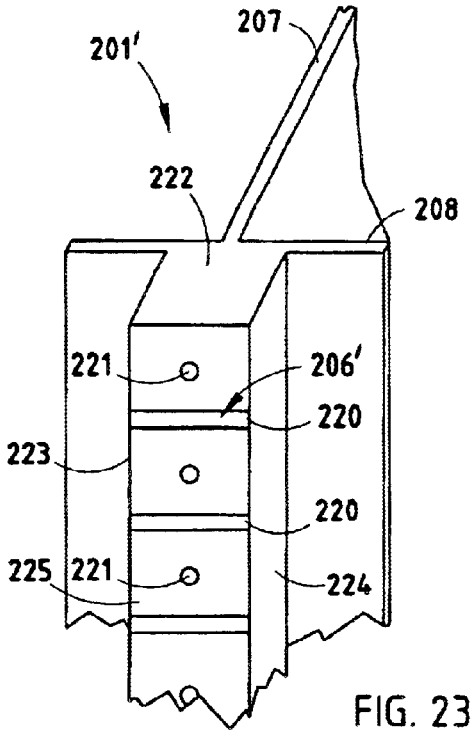
Figure 24:
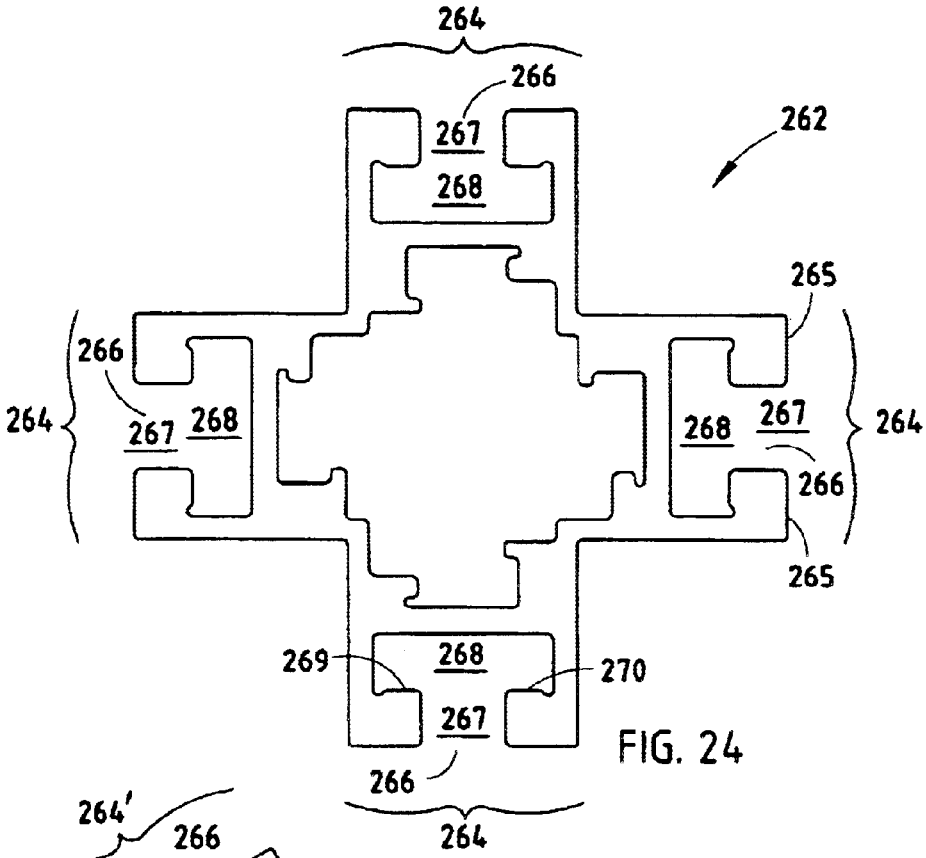
Figure 24A:
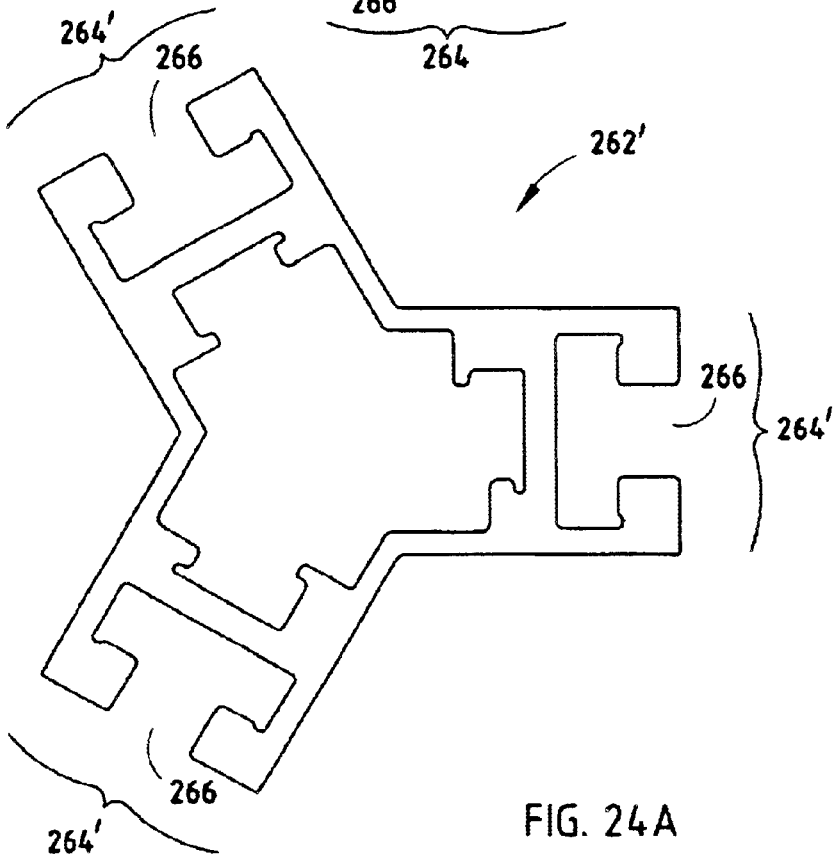
Figure 25:
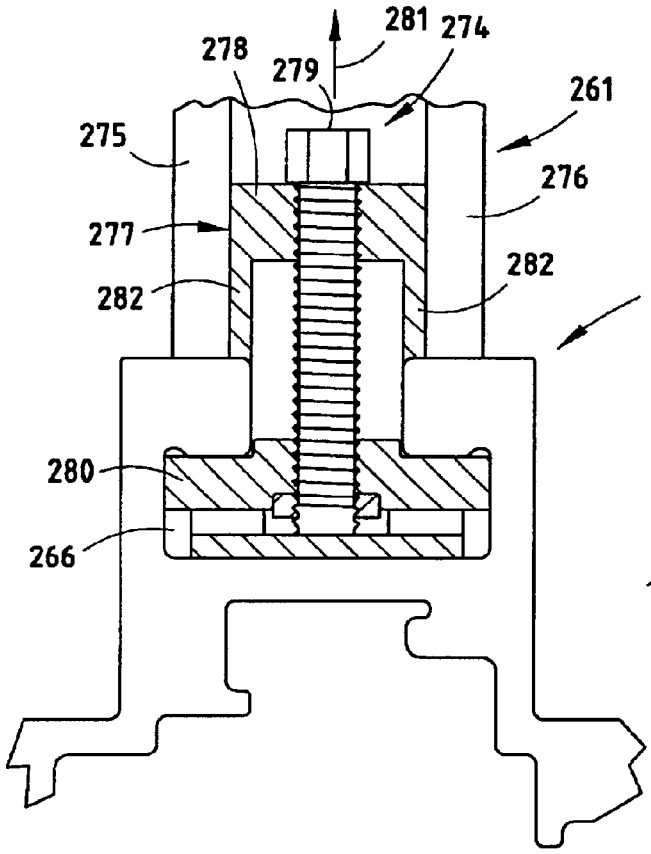
Figure 28:
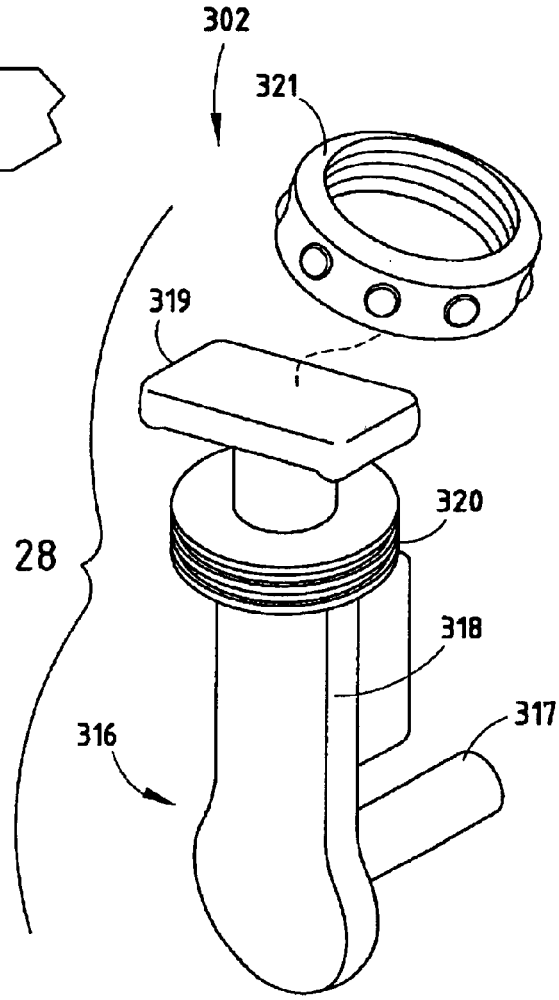
Figure 26:
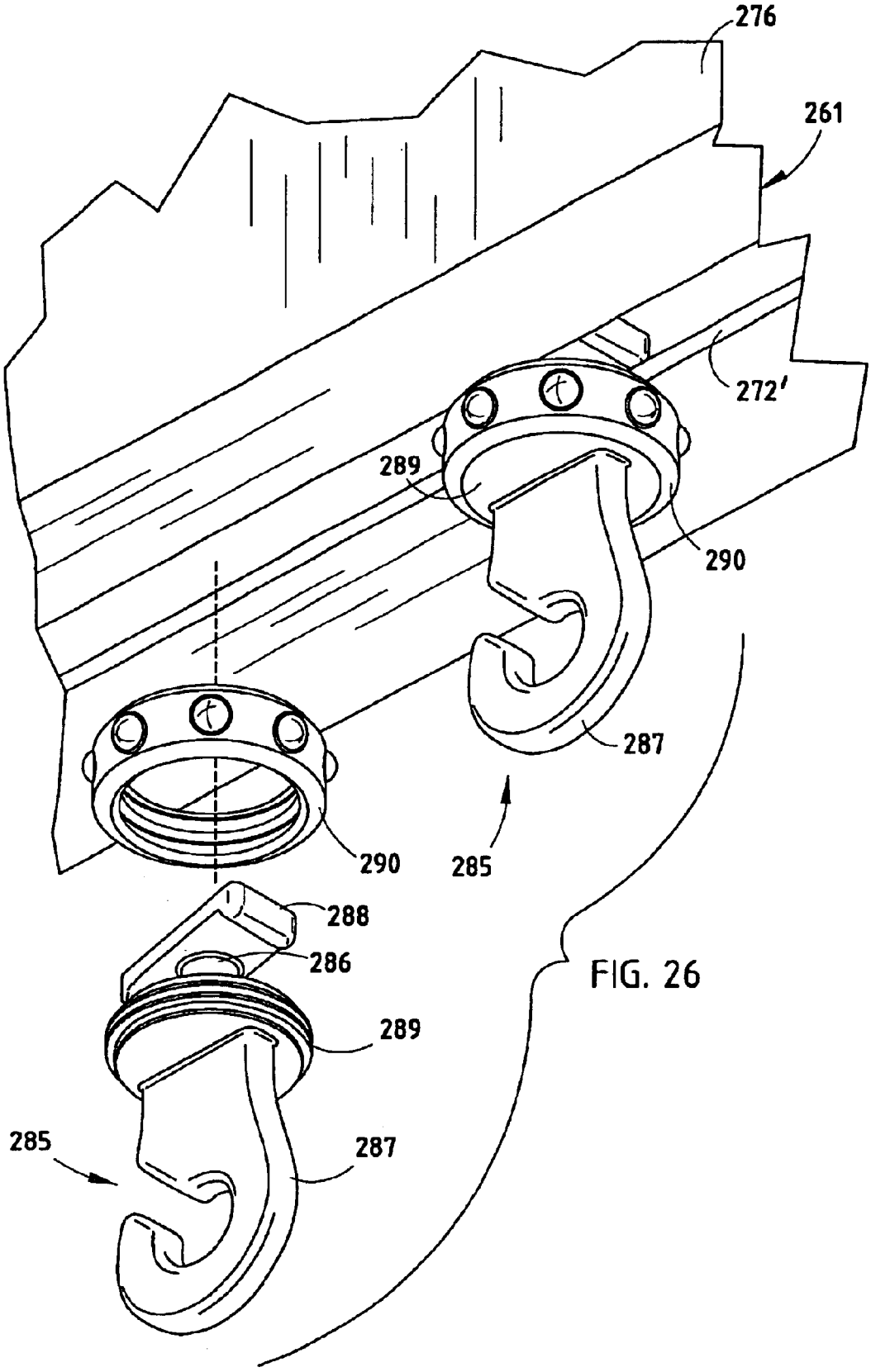
Figure 27:
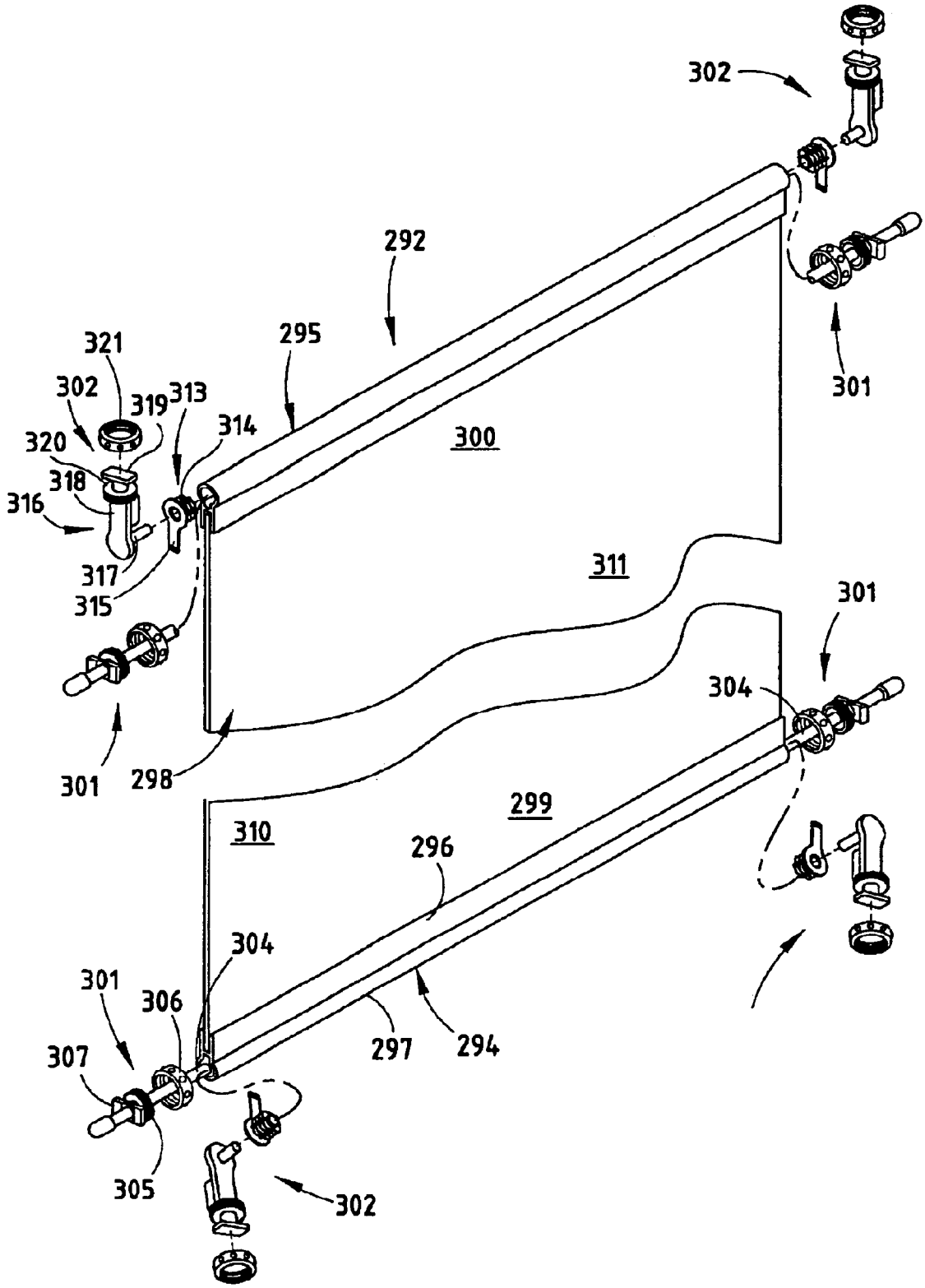
Figure 29:
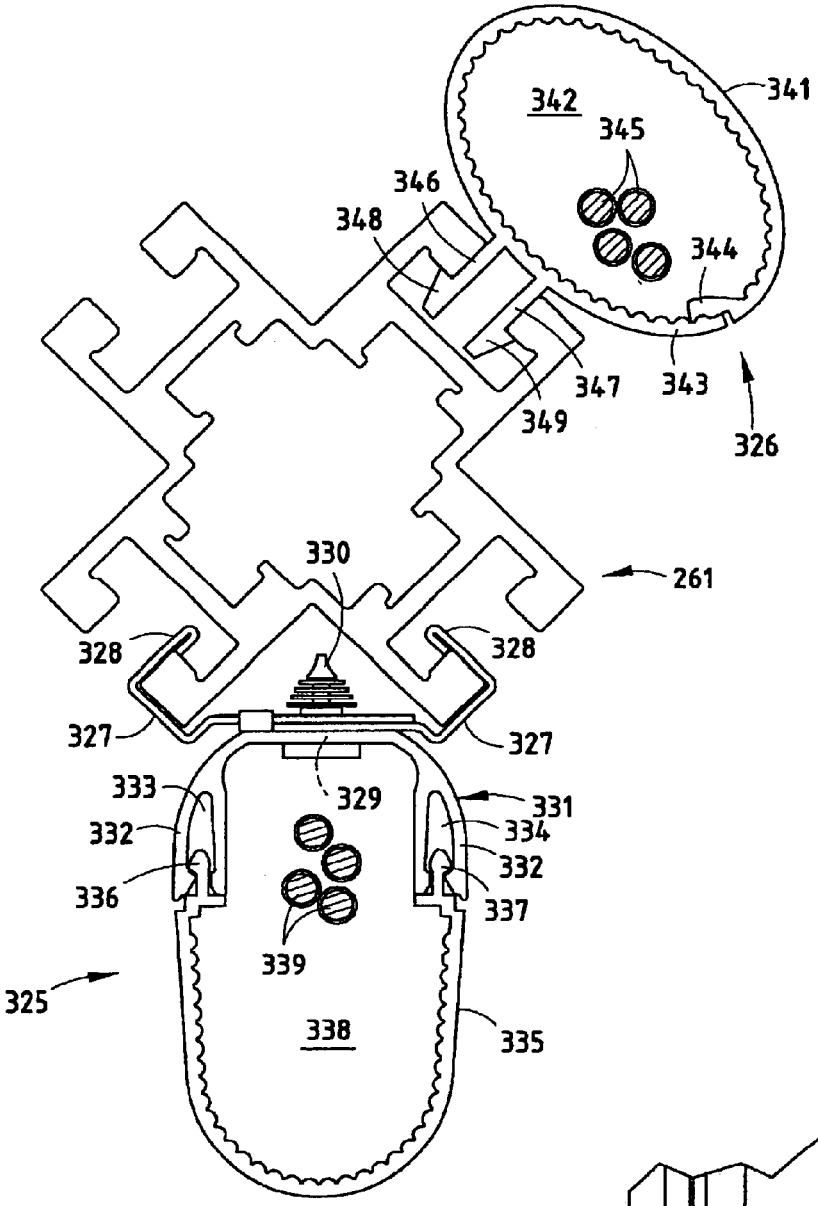
Figure 30:
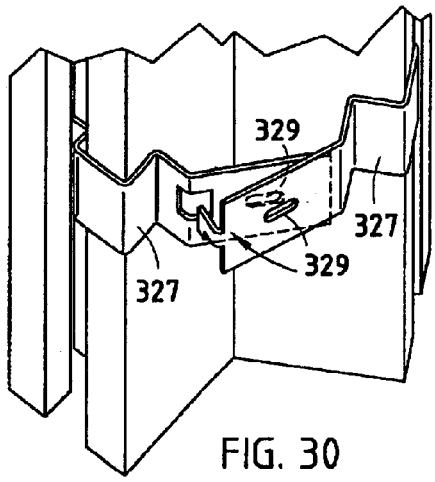

FIG. 22 is a perspective view of a building space including the partition system shown in FIG. 1, and further including a post-and-beam overhead frame system and including an architectural-wall-covering system;

FIG. 23 is a cross section taken along line XXIII—XXIII in FIG. 22, showing the slot-forming structure integrated into the building-wall-covering system;

FIG. 23A is a perspective view of the extrusion shown in FIG. 23;

FIG. 23B is a perspective view of an alternative slot-forming member similar to the one shown FIG. 23A but having a different slot structure therein;

FIGS. 24 and 24A are cross sections taken along the line XXIV—XXIV and the line XXIXa–XXIVa in FIG. 22, showing a shape of the post of the post-and-beam system;

FIG. 25 is a fragmentary view of the slot in the post of FIG. 24, and showing the attachment structure for attaching an accessory to the slot;

FIG. 26 is a perspective view of two hook accessories, one hook being exploded away from the slot structure of the overhead framework of the post-and-beam system, and one hook being engaged with the slot structure;

FIG. 27 is an exploded perspective view of a screen adapted for attachment between the post on one side and to a partition on the other side (see the screen in the lower left corner of FIG. 22), the exploded view showing two different attachment connectors for each corner of the screen;

FIG. 28 is an exploded enlarged view of one of the connectors shown in FIG. 27;

FIG. 29 is a cross section of a post similar to FIG. 24, including two wire manager accessories attached to the post, the first being located between T-slots on the post and the second being attached in front of a T-slot on the post; and FIG. 30 is a perspective view of the bracket that secures the first wire manager accessory to the post, the bracket being partially assembled to better show its attachment.

DETAILED DESCRIPTION OF PREFERRED EMBODIMENTS

The illustrated prefabricated systems (FIG. 1) for outfitting a building space are provided with a common accessory attachment feature. A plurality of accessories are provided that can be attached to the common accessory attachment feature, thus providing a highly adaptable and flexible system that facilitates customization and optimal utilization of the building space. The illustrated prefabricated systems include a partition system 30 (FIGS. 1–22), a building-wall-covering system 200 (FIGS. 22–23B), and a post-and-beam overhead frame system 260 (FIGS. 22 and 24–26 and 29–30). However, it is contemplated that numerous additional systems can be easily constructed using the present inventive concepts. Accordingly, it is not believed to be necessary to show every such possible system, in order for the present claims to cover such products. Therefore, the term "architectural systems" as used herein is intended to include items such as an outer-wall-covering system, an interior-wall-covering system, an interior-wall-forming system, a post-and-beam overhead frame system, a building-column-covering system, a raised floor system, a drop ceiling system, and an overhead utility-carrying bulkhead system. Also, the term "furniture systems" is intended to include items such as a full-height partition system, a partial-height partition system, a partition-attached furniture system, a free-standing furniture system, a cabinet/storage system, and the like.

Partition System With T-Slot Structure

A partition system 30 (FIG. 1) includes partitions 31 adjustably interconnected and outfitted to form offices. Tops and exposed ends of the partitions 31 are covered with top and end trim pieces 33 and 34, for aesthetically covering and protecting the partitions. The illustrated trim pieces 33 and 34 are made of structural material and have beefed-up sections with elongated T-slots formed in their exposed surface, and further, they are securely attached to the partitions 31. By this arrangement, a plurality of different accessories can be adjustably mounted to tops and ends of the trim pieces 33 and 34 on the partitions 31. The illustrated accessories include a wire manager system 35, a hook 36, a screen 37, an upright/lateral erasable marker board 38, a hanging binder bin 39, a hanging shelf 40, a hanging erasable marker board 41, a top-mounted cantilevered light 42, a top-mounted cantilevered document holder 43, and a side-attached table 44, but it will be clear to persons skilled in the art of furniture after reading the description below that additional accessories can be developed using the present inventive concepts.

The present inventive concepts can be adapted for use on most any partition or wall structure. The illustrated partitions 31 are sufficiently described below for an understanding of the present invention by persons skilled in this art. Nonetheless, additional detailed discussion of the partitions 31, their structure and advantages of their construction can be found in the following patent applications, the entire contents of which are incorporated in their entirety by reference: co-assigned application Ser. No. 10/077,553, filed Feb. 15, 2002, entitled PANEL SYSTEM; and co-assigned application Ser. No. 10/076,709, filed Feb. 15, 2002, entitled PARTITION PANEL WITH MODULAR APPLIANCE MOUNTING ARRANGEMENT; and co-assigned application Ser. No. 10/113,139, filed Mar. 29, 2002 (filed same day as present application), entitled PARTITION TRIM HAVING FUNCTIONAL ASPECTS.

The illustrated partitions 31 (FIG. 5) each include a frame assembly 50 having two end frame members 51 and 52, a top frame member 53, and a bottom frame member 54 forming a perimeter frame. The frame assembly 50 may also include one or more optional intermediate frame members 55, and one or more optional intermediate accessory frame members 56. The frame members 51–56 are covered using removable covers 57 (FIG. 1), and are secured together to form a rigid structure suitable for supporting work surfaces 58, and other furniture and accessories commonly associated with office and subdivision of building space. The illustrated frame assembly 50 further includes adjustable glides or "feet" 59 so that the partitions 31 can be leveled to accommodate unevenness in floors.

Figure 11:
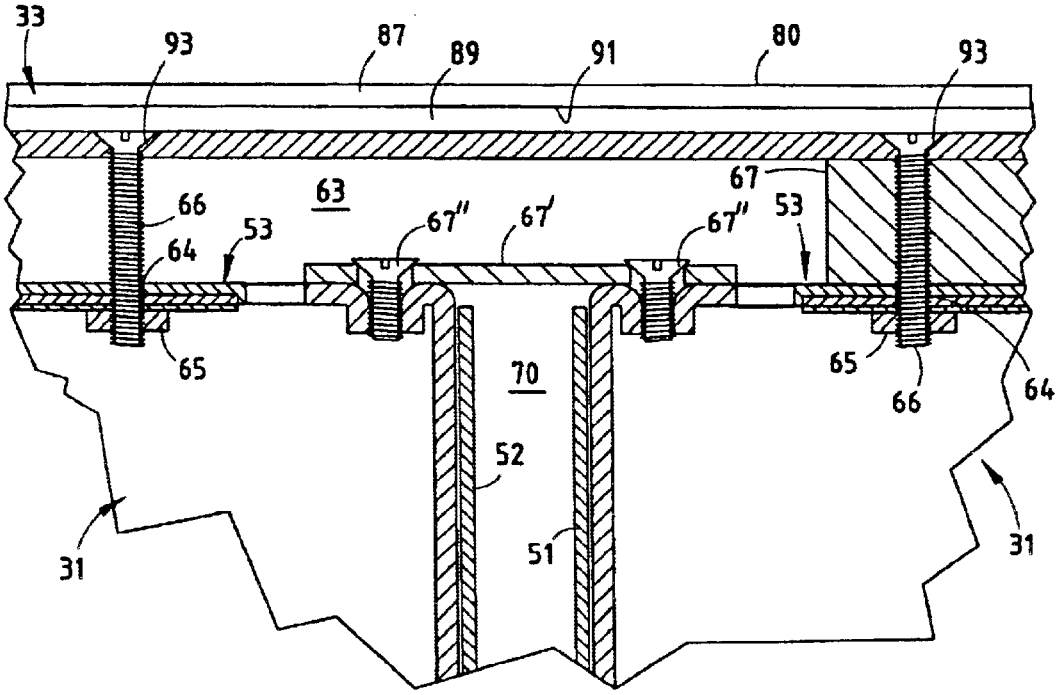
FIG. 11 is a cross section taken along the line XI—XI in FIG. 10, including a trim piece mounted thereto.
Figure 12:
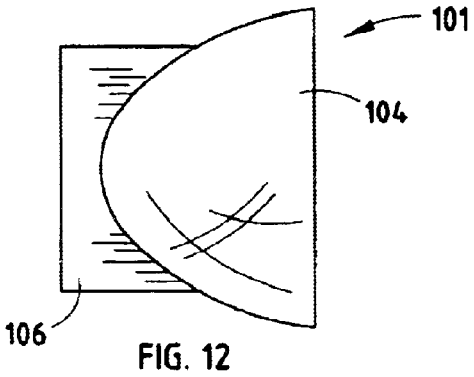

The top frame member 53 (FIG. 8) has a cross section with the flat center wall 60 and upwardly protruding rectangular side ridges 61 and 62 that define a center channel 63 between them. The ridges 61 and 62 include upper/outer corners with a horizontal row of longitudinally-extending short slots 63', which can be engaged with hooked brackets for supporting furniture articles such as binder bins, shelves, and the like. The center wall 60 includes a series of holes 64 with threaded nuts 65 tack-welded under the holes 64. Long bolts 66 are extended through mating holes in the trim piece 33 and threadably into the holes 64 and nuts 65. Depending on a depth of the channel 63, the number of bolts 66, and a lateral strength requirement of the attachment, a foam block 67 (FIG. 11) or similar stabilizer can be added to each connection. If desired, the block 67 can have concave sides to allow for longitudinal passage of wires past the block 67. In FIG. 11, a connector plate 67' extends into channels 63 in adjacent frames 50, and screws 67" secure the connector plate 67' to the frames 50 to align and interconnect the frames 50.

Figure 9:
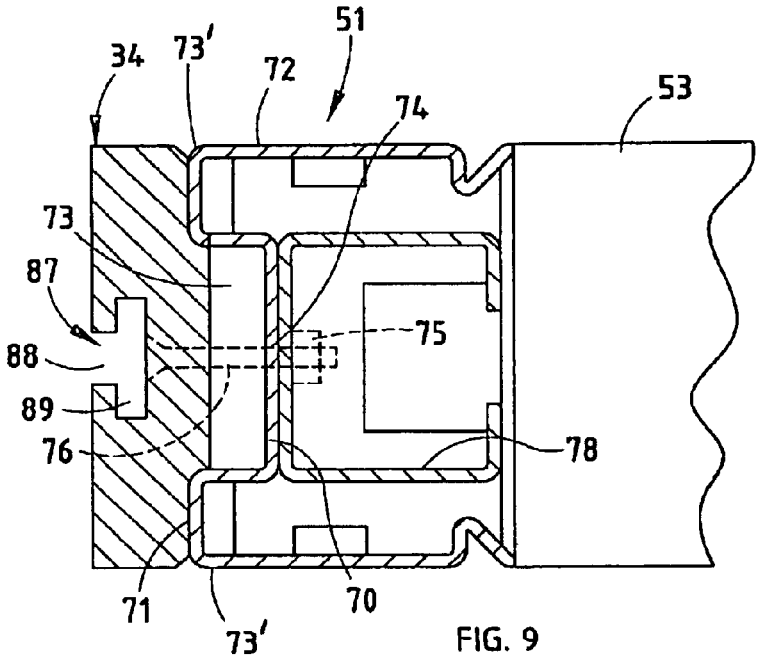
Figure 10:
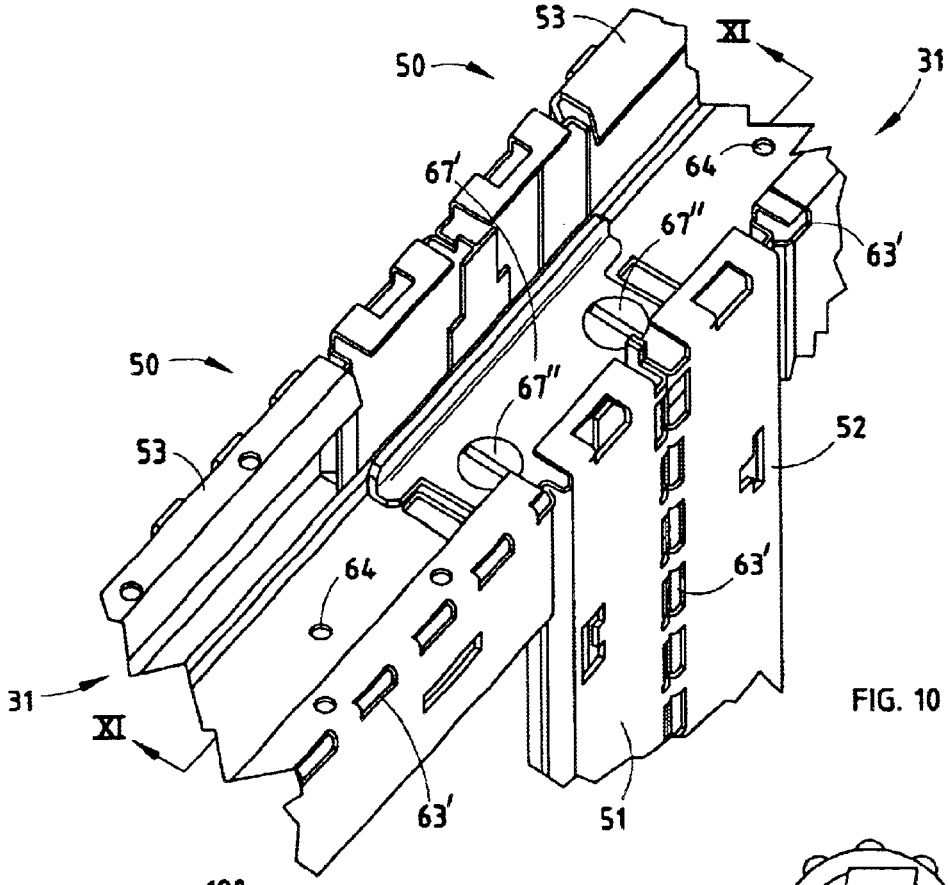
FIG. 10 is an enlarged view of the circled area X in FIG. 2.

The end frame member 51 (and 52) (FIG. 9) is similar to the top frame member 53, although the channel that it defines is much shallower. Specifically, the end frame member 51 includes a cross section with a flat center wall 70, and outwardly protruding rectangular side ridges 71 and 72 that define a channel 73 between them. The ridges 71 and 72 include outer corners with a vertical row of longitudinally-extending short slots 73', which can be engaged with hooked brackets for supporting furniture articles. The center wall 70 includes a series of holes 74 with threaded nuts 75 tack-welded under the holes 74. Long bolts 76 are extended through mating holes in the trim piece 34 and threadably into the holes 74 and nuts 75. Blocks similar to blocks 67 can be used if increased stability of the bolts 76 is needed, but it is contemplated that stabilizing blocks will not be needed due to the short length of the bolts 76. Also, it is noted that the frame members 51 (and 52) are stabilized by a reinforcement 78 under center wall 70 (FIG. 9).

The top trim piece 33 (FIG. 3) has a width and length chosen to cover a top surface of the partition 31. Notably, the length of the top trim pieces 33 can be longer or shorter than individual partitions 31, as long as a total length equals a length of an interconnected run of partitions 31. (Notice in FIG. 1 that some top trim pieces 33 span two partitions 31.) The illustrated trim piece 33 (FIG. 3) includes flat top and side surfaces 80 and 81, and includes a bottom surface 82 with flat landings 83 and 84 for resting on the protruding ridges 61 and 62. The bottom surface 82 further includes a down-ridge 85 that extends partially into the channel 63. The down-ridge 85 has a width so that its edges abut the inside corners of the ridges 61 and 62, thus centering the trim piece 33 on the top frame member 53. If increased stability is desired, the outer edges of the side surfaces 80 and 81 can include a down lip so that the protruding ridges 61 and 62 are positively captured. A top surface of the top trim piece 33 is relatively flat, with the exception of a center area where the T-slot 87 is formed. The T-slot 87 includes a neck portion 88 and a wide portion 89 with blind surfaces 90 and 91. A bottom flange 92 forms a bottom of the T-slot 87. Holes 93 are bored through the bottom flanges 92, and each includes a recess 94 for receiving a head of the bolt 66. By this arrangement, when the bolts 66 are in an assembled position, the head of the bolt 66 is removed from the T-slot 87, so that the bolt 66 does not interfere with use of the T-slot 87. It is also noted that the top trim piece 33 could be attached by extending screws through the top trim piece 33 at positions outside the T-slot 87 and into the side ridges 61 and 62.

A cross sectional shape of the trim piece 33 can be varied for aesthetics and functional reasons. The illustrated cross sections shape of trim piece 33 includes a flat top surface 80 and flat side surfaces 81 that define a rectangular shape. However, the top surface can be modified as shown by top trim piece 33A, which includes top surface 80' with a dish-shaped recess 96. This dish shape has an aesthetic appeal, and when used with the wire manager system 35, also provides increased room for routing wiring along a top of the partition 31, as described below. It is noted that the trim piece 33 can span aligned adjacent partitions 31 (see FIG. 1, the top left two partitions). It is also noted that the dish-shaped recess 96 could be divided in half by a vertical flange, so as to subdivide and separate recess 96 into two channels, one being for communication wiring and one being for power electrical wiring.

The illustrated slots 87 work particularly well, since accessories can be positioned anywhere along the top or ends of the partitions 31. However, a scope of the present inventive concepts is believed to include other attachment features, such as a protruding ridge (e.g. a T-shaped ridge), a plurality of discrete locations instead of continuous slot (e.g. a series of holes or short slots, not unlike the slots 63' in top frame member 53). Hook and loop material could also be used.

The illustrated end trim piece 34 (FIG. 9, but also see FIGS. 1 and 3) has the same cross sectional shape as the top trim piece 33, and accordingly, a second description is not necessary for an understanding of trim piece 34. The illustrated end trim piece 33 is interchangeable with top trim piece 33, except perhaps for its length, which will vary depending upon the partitions 31.

As noted above, the illustrated accessories include a wire manager system 35, a hook 36, a screen 37, an erasable marker board 38, a hanging binder bin 39, a hanging shelf 40, a hanging erasable marker board 41, a top-mounted cantilevered light 42, a top-mounted cantilevered document holder 43, and a side-attached table 44. Each accessory includes at least one anchor that operably engages a blind surface in the T-slot and further includes a base opposing the anchor, so that as the anchor is drawn toward the base, the arrangement clampingly and stably retains the accessory to an exposed outer surface of the trim piece 33 (or 34) and hence to the associated partition 31. Depending on the functional needs of the accessory, such as the need for stability, the need to provide torque to resist lateral forces (such as may occur when a person is writing on an erasable marker board), the need for styling and/or aesthetics, and other considerations, the visible portion of the base can be varied, or multiple bases and anchors can be used, or both.

The illustrated wire manager system 35 (FIG. 1) includes a tunnel element 100, a terminator element 101, and an overhead-utility down-feed element 102. The overhead-utility down-feed element 102 is adapted to communicate utilities, such as wires, downwardly from a ceiling or from an overhead framework of a post-and-beam furniture system. The tunnel element 100 has an inverted U-shaped cross sectional shape (FIG. 15A) that forms an inner passageway 103, and has a width selected so that the legs of the U-shape can rest on a top trim piece 33 of a partition 31. The overhead-utility down-feed element 102 (FIG. 1) includes a side wall facing the direction of the tunnel element 100, with a cut-out 102' shaped to mateably engage the tunnel element 100, such that the tunnel element 100 can be extended into the cutout for optimal aesthetics. At the other end of the tunnel element 100, the terminator element 101 is positioned. The terminator element 101 (FIGS. 12–16) has a half-cup-shaped body 104 with a lip 105 forming an open mouth for receiving the end of the tunnel element 100. A base flange 106 extends around the down side of the body 104, and is adapted to rest on the top trim piece 33. A first pair of legs 107 and 108 extend downwardly from a middle area of the cup-shaped body 104. The legs 107 and 108 are resilient, and include hooks 109 and 110 on their ends that are shaped to releasably engage opposing sides of the T-slot 87 to retain the body 104 on the top trim piece 33. Additional secondary legs 111 can be located between the legs 107 and the sides of the body, for providing additional stability and strength to the body 104. It is noted that the tunnel element 100 can extend longer or shorter than the partition 31, and longer or shorter than the top trim 33 on which it rests.

In FIG. 1, the down-feed element 102 drops wires 114 to one end of the partition 31, and the tunnel element 100 extends across a top of and past that partition 31 onto the top of a second partition 31. This allows wires 114 located within the tunnel element 100 to be communicated across a top of the first partition 31 and then down into the second partition 31, without having to route the wiring through the first partition 31 into the second partition 31. (The wires 114 are extended along the T-slot 87 to light 42.) This arrangement of wire management greatly facilitates office rearrangements, since the wiring is easy to reach, see, and re-route.

The hook 36 (FIGS. 17–19) includes a center stem 116 with a hook element 117 on one end and a transverse segment or anchor 118 on its other end. The stem 116 and anchor 118 form an inverted T-shape. A base or disk 119 is attached to the center stem 116 at a location spaced from the anchor 118. The outside of the disk 119 is threaded, and a nut 120 is threaded onto the disk 119. To insert the hook 36 into the T-slot, the anchor 118 is oriented so that it aligns with the neck portion 88 of the T-slot 87. In this position, the anchor 118 fits through the neck portion 88 of the T-slot 87. The stem 116 and anchor 118 are then rotated 90-degrees, which causes the anchor 118 to move into the wide portion 89 of the slot 87, with its ends engaging the blind surfaces 90 and 91 on the T-slot 87. The nut 120 is then rotated while the hook element 117 is held stationary, such that the nut 120 threadably moves downwardly on the disk 119 until the nut 120 clamps against the marginal material of the top trim piece 33 forming the neck portion 88. Due to a width of the nut 120 and of the anchor 118, the hook 36 is stably held on the top trim piece 33. The hook 36 can similarly be attached to the end trim piece 34 (see FIG. 1).

The screen 37 (FIG. 20) includes a bent-wire frame 123 covered with a screen fabric material 124. The frame 123 includes a lower horizontal frame member 125 with an up-bend 126 at its corners. The frame 123 includes side frame members 127 with foot sections 128 that extend below the up-bend 126. The foot sections 128 are not unlike the stem 116. The foot sections 128 include a transverse segment or anchor 129 on its other end, which forms an inverted T-shape. A base 130 is attached to the foot section 128 at a location spaced from the anchor 129. The base 130 includes a disk 130' that is threaded, and a nut 131 that is threaded onto the disk 130'. To insert the anchor 129 into the T-slot, the anchor 129 is oriented so that it aligns with the wide portion 89 of the T-slot 87. In this position, the anchor 129 slops into an end of the T-slot, with the anchor 129 engaging the blind surfaces 90 and 91 on the T-slot 87. The nut 131 is then rotated while the frame 123 is stationary, such that the nut 131 threadably moves downwardly on the disk 130' until the nut 131 clamps against the marginal material of the top trim piece 33 forming the neck portion 88. Due to a width of the nut 131 and of the anchor 129, the screen 37 is stably held on the top trim piece 33. The screen 37 can similarly be attached to the end trim piece 34 (see FIG. 1). In such case, the screen 37 extends laterally outward from the partition 31 in a plane of the partition 31.

It is contemplated that a window (e.g. a plexiglass with extrusion perimeter frame), or translucent panel, or opaque panel (e.g. a slatwall section, or a laminate with colored plastic outer surface or wood grain outer surface) can be attached to the trim pieces 33 and/or 34 in a manner like screen 37.

Two erasable marker boards 38 and 41 are shown in FIG. 1, with marker board 38 extending laterally or upwardly from the partition 31, and the marker board 41 lying against a face of the partition 31. Specifically, the marker board 38 includes a perimeter channel frame 135 with white erasable marker board material 136 inside the channel frame 135. Two legs 137 extend laterally from the perimeter channel frame 135. Each include a threaded stem, an anchor, a base/disk, and a threaded nut, similar to those described above for the screen 37. The marker board 38 can be attached to the top trim piece 33 or to the end trim piece 34 (as shown), and extends outwardly from the partition 31. The marker board 41 includes an L-shaped bracket 139 (FIG. 21) having a top leg 140 (FIG. 21) that extends across the top trim piece 33. A pair of stems 145, anchors 146, disks 147, and threaded nuts 148 extend from the top leg 140 for clamping engagement with the T-slot 87 on the top trim piece 33. The bracket 139 includes a down leg 141 that extends downwardly flush against a face of the partition 31. The down leg 141 has a length so that it positions an erasable surface 142 (FIG. 1) at a desired height on the face of the partition 31. The illustrated erasable board 41 has a perimeter channel frame 143 and a white erasable surface 144 like the marker board 38.

The hanging binder bin 39 (FIG. 1) is mounted on an L-bracket 139' similar to the L-bracket 139 for the erasable marker board, but the L-bracket 139' is beefed up for the additional weight that it is likely to carry. A pair of brackets 139' can be used if necessary to support the binder bin 149.

The hanging shelf 40 (FIG. 1) is mounted on a pair of bent-wire side supports 150. The supports 150 have a triangular end with a horizontal segment 151 adapted to carry a shelf panel 152 in a horizontal position. The supports 150 further have an angled segment 153 to a top tip at the top trim piece 33. A rear leg of bent-wire 155 extends from the top tip across a top of the top trim piece 33, and includes a stem, an anchor, a base/disk, and a threaded nut, as previously described.

The top-mounted cantilevered light 42 and the top-mounted cantilevered document holder 43 each include a panel base plate 160 that engages a top of the top trim piece 33. Each include a stem, anchor, (base plate 160), and at least one nut 161 for clamping retention to the T-slot 87 of the top trim piece 33.

It is contemplated that furniture can be attached to the slots 87. For example, the side-attached table 44 includes a stem, anchor, base, and nut for retaining the table 44 adjacent the end trim piece 34 of the partition 31. It is contemplated that benches, chairs, or the like could also be coupled to or tethered to the partition 31.

An advantage of mounting the accessories 35–44 anywhere along the partitions 31 is that it provides infinite and easy adjustability. This lets the office worker locate accessories in optimal locations and positions for workflow, and lets the worker adjust for changing needs and preferences. Customization of an office leads to individuality, identity, and personality of a workspace, as well as pride and ownership of the space. The user can easily adjust his office to changing needs without requiring skilled trades assistance in order to make the change. Further, the accessories are mounted in areas not previously used, such as areas directly above the partitions and off free ends of the partitions, which areas were previously wasted space and/or at least under-utilized.

Building Wall-Covering System With T-Slot Structure

The building-wall-covering system 200 (FIG. 22) includes an elongated mounting member 201 having a T-shaped section 202 (FIG. 23A) shaped for attachment to conventional wall-forming studs 203 (FIG. 23), and having a second section 204 shaped for supporting edges of drywall sheets 205 and for forming an accessory-mounting feature, (i.e. T-slot 206). In particular, the T-shaped section 202 includes a long flange 207 adapted to fit between and matably engage opposing C-shaped metal studs 203 and transverse flange 208*s* forming a top part of the "T" shape. As illustrated, conventional drywall screws 209' are extended through the both studs 203 and the flange 207. Alternatively, the flanges 207 and 208 can be abutted against a single stud, such as a 2×4 wood stud, and nailed securely thereto.

The second section 204 is formed by a front side of the transverse flange 208 and by a box-like configured section 210 located opposite the long flange 207. The edges 211 of the drywall sheets 205 are abutted against sides of the configured section 210 and against the front side of the transverse flange 208, where they are screwed in place using screws 212. It is noted that additional flanges 208' can be extended from a front surface 213 of the configured section 210 in a direction parallel the transverse flange 208 to form a pocket that captures the edge 211, if desired.

The front surface 213 of configured section 210 has a depth and width, allowing it to form the accessory-mounting feature 206. The illustrated section 210 includes a neck portion 215 and a recessed wide portion 216 forming the T-slot, with blind surfaces 217 and 218 being present for engaging an anchor as previously described in regard to accessories 35–44 attached to partitions 31. The illustrated mounting member 201 in FIG. 23A is extruded. However, it is contemplated that the mounting member 201 can be made in different ways. For example, the modified mounting member 201' (FIG. 23B) is potentially rollformed or made as a weldment. Also, the accessory-mounting feature (206) can comprise different structures other than a T-slot. For example, the accessory-mounting feature 206' comprises a series of vertically spaced, horizontally-extending short slots 220 and/or alternatively comprises holes 221. In mounting member 201', an optional end flange 222 is provided that engages sidewalls 223 and 224 and front wall 225 of the "configured section" in a manner that stabilizes the cross section against a parallelogram-type collapse.

A trim piece 226 (FIG. 23) can be attached to the mounting member 201 (or 201') to aesthetically cover the face of the mounting member 201 when the accessory-mounting feature 206 is not in use. Advantageously, the trim piece 226 eliminates the need to mud, tape, and sand joints in the drywall, thus saving considerable time and expense. The trim piece 226 includes a plate-like cover portion 227 having a width sufficient to cover the heads of the screws 212. A retainer 228 is provided on a back of the trim piece 226, which as illustrated comprises a pair of resilient legs with hooks 229 shaped to frictionally engage the blind surfaces 217 and 218 of the mounting feature 206 (or 206').

It is contemplated that an extrusion or roll-formed mounting member like member 201 can be used on a raised floor, or a drop ceiling, or a building column cover, or on an interior-wall-covering system. In such case, the drywall sheets (205) would be replaced with an acceptable panel, such as a floor panel for a raised floor, or a ceiling panel in a drop ceiling. A system of parallel T-slots or an orthogonal grid of T-slots would be created for attachment of accessories thereto.

Post-And-Beam System With T-Slot Structure

The illustrated post-and-beam overhead frame system 260 (FIGS. 22 and 24–26 and 29–30) includes horizontal beams 261 fixedly interconnected to form an overhead framework, and vertical posts 262 fixedly attached to the overhead framework to support the overhead framework at a selected height. Post-and-beam products are well known in the art, and are often used to form teaming areas or open office arrangements. The illustrated post-and-beam product with overhead frame is sufficiently described below for an understanding by those skilled in the art. However, additional details of the post-and-beam product are described in the following patent applications, the entire contents of which are incorporated herein in their entirety: co-assigned application Ser. No. 09/800,006, filing date of Mar. 6, 2002, entitled POST AND BEAM FURNITURE SYSTEM; co-assigned application Ser. No. 09/800,007, filing date of Mar. 6, 2001, entitled EXTERNAL WIRE MANAGER FOR POST AND BEAM FURNITURE SYSTEMS; co-assigned application Ser. No. 09/800,005, filing date of Mar. 6, 2002, entitled SERPENTINE IN-FILL PANEL FOR POST AND BEAM FURNITURE SYSTEMS; co-assigned application Ser. No. 09/694,645, filing date of Oct. 23, 2000, entitled REMOVABLE FOOT FOR FURNITURE POST AND METHOD FOR LEVELING SAME; and co-assigned application Ser. No. 09/694,646, filing date of Oct. 23, 2000, entitled CANTILEVERED SUPPORT FOR FURNITURE BEAM.

The illustrated posts 262 (FIG. 24) of the post-and-beam system 260 have an X-shaped cross section, with four legs 264 that extend outwardly. Each leg 264 has opposing L-shaped flanges 265 that define a T-slot 266. The T-slot 266 has a neck portion 267 and a recessed wide portion 268, with blind surfaces 269 and 270. The T-slot 266 is identical to or similar to the T-slot 87 of the partition 31 and the T-slot 206 of the architectural building-wall-covering system 200. A modified post 262' includes a Y-shaped cross section (FIG. 24A), with legs 264' each forming one of the T-slots 266. A short post 262" is identical to posts 262, but is only long enough to support a low height "fence-like" structure. (See also the low-height work surface 363 under the hanging screen 362.)

The horizontal beams 261 (FIG. 22) are extruded members (or rollformed members) and have one (or more) T-shaped slots 272 formed in their sidewalls and extending longitudinally, and have one (or more) T-shaped slots 272' formed in their bottom walls (FIG. 26) and extending longitudinally. FIG. 25 illustrates how the horizontal beams 261 are mounted to sides of the posts 262 using a connector 274. Specifically, the beams 261 include spaced-apart sidewalls 275 and 276, with a stanchion 277 extended therebetween. The stanchion 277 includes a transverse wall 278 through which a clamping bolt 279 threadably extends. An anchor 280 is positioned in the T-slot 266 on a post 262. The clamping bolt 279 engages the anchor 280 and, as the clamping bolt 279 is turned, the bolt 279 telescopes in direction 281 drawing the anchor 280 with it. This results in a clamping force between the anchor 280 and legs 282 of the stanchion 277, thus fixing the beam 261 to a selected post 262 at a selected height.

Accessories 35–44 and additional accessories (described below) can be mounted to the T-slots 206 of the wall-mounting member 201, or to the T-slots 266 of the post 261 and to the T-slots 272 and 272' of the beams 262. For example, a hook 285 (FIG. 26) (similar to hook 36, FIG. 1) includes a center stem 286 with hook element 287, and an anchor 288 on its end. A base or disk 289 includes a threaded exterior surface, and a nut 290 operably engages the threads. The anchor 288 has a narrow dimension allowing it to fit through the narrow portion of the T-slot 272' (or T-slot 272, or 266, or 206, or 87). After the anchor 288 is inserted into the slot 272', the anchor 288 is rotated about 90-degrees, which causes it to engage the blind surfaces of the T-slot 272' in a manner preventing its withdrawal. As the nut 290 is rotated, it clampingly engages the marginal material forming the T-slot 272', causing the hook 285 to become securely attached to the beam 262.

The screen 292 (FIG. 27) is configured to be attached between two slot-forming members, such as between two posts 261, or between a post 261 and an end trim piece 34 on a side of the partition 31, or between a beam 262 and a top trim piece 33 of a partition 31. For example, see the screen 292 in FIG. 22. Also, notice the screens 292A and 292B, which are identical to screen 292, but where screen 292A is attached between a post 262 and the T-shaped section 202 on the building-wall-covering system 200, and where screen 292B is attached between an end trim piece 34 of a partition 31 and the T-shaped section 202 on the building-wall-covering system 200. The screen 292 (FIG. 27) includes edge-retaining extruded sections 294 and 295, each of which include a tube portion 296 and gripper flanges 297. A panel of screen sheet material 298 includes a first edge 299 frictionally retained by gripper flanges 297 on one side, and a second edge 300 frictionally retained by gripper flanges 297 on its other side. Two different connectors 301 and 302 are provided for engagement with open ends 303 of the tubes 296. The first connector 301 includes rod 304 that extends through the tube portion 296 on the top extruded section 294. A base or fixed disk 305 is attached to each end of the rod 304, and a nut 306 is threaded onto an exterior surface of each disk 305. An anchor 307 is attached to the rod 304 near each end.

The first connector 301 is adapted to engage a T-slot that extends parallel the third and fourth edges 310 and 311 of the sheet material 298. For example, the first connector 301 was used on the screen 292 shown in FIG. 22 (in the foreground, i.e. the lower left portion of FIG. 22), where the screen 292 is attached between a post 261 and an end trim piece 34. The same screen 292 (including connectors 301) could also be attached below a beam 262, between the slot 272' of the beam 262 and a top trim piece 33 of a partition 31, with the screen 292 being oriented at 90-degrees from the orientation as it is shown in FIG. 22. However, this would orient the extruded sections 294 and 295 in a vertical direction, allowing the flexible screen material to "droop" across its width.

Of course, the screen material could be made stiffer, such as by replacing the flexible screen material with a rigid panel or board of material. Specifically, it is contemplated that an erasable marker board or slatwall could be constructed by replacing the flexible screen material with an erasable board material (e.g. a "white board") and/or by replacing the extruded sections (294) with a perimeter frame that extends completely around the screen material and that has the connectors 301 (or 302) thereon.

The second connector 302 (FIG. 27) includes a friction member 313 having a resilient end 314 shaped to frictionally engage an end of the tube portion 296. A body 315 of the friction member 313 extends laterally, and forms a handle that can be used to "wind up" the screen material 298 on the extruded section 294 or 295. The connector 302 includes a clamp member 316 (see also FIG. 28), having a rod section 317 (FIG. 27) that extends through a hole in the friction member 313 into the tube portion 296. A body 318 extends laterally from the rod section 317. An anchor 319 and a base or disk 320 are attached to the body 318, and a nut 321 is threaded onto the disk 320. Notably, the nut 321 and anchor 319 are oriented at 90-degrees from the nut and anchor of the first connector 301. Thus, the second connector 302 is able to connect to the T-slots in a different direction than the first connector 301. For example, if the screen 292 has the second connectors 302 on its opposing sides (instead of the first connectors 301), the screen 292 can be attached under the beam 262 to the bottom beam slot 272' and to the top slot 87 on the top trim piece 33 of the partition 31, with the extruded sections 294 and 295 extending horizontally at top and bottom edges of the screen 292.

Two wire managers 325 and 326 are illustrated as mounted to the post 261 in FIG. 29. The wire manager 325 includes a pair of straps 327 each having a hook 328 on their ends and having a center hole 329. The straps 327 can be arranged so that the hooks 328 engage and grip adjacent sides of the T-slots 266 on the post 262, with the holes 329 aligned at a middle area. When aligned, the holes 329 can be engaged by a carrot fastener 330 on a U-shaped extrusion 331. The U-shaped extrusion 331 includes side flanges 332 forming grooves 333 and 334. A mating U-shaped extrusion 335 includes side flanges 336 and 337 that snap into the grooves 333 and 334, thus forming an enclosed passageway 338 between the extrusions 331 and 335. Wires 339 can be routed along the passageway 338 as needed. The wire manager 325 is conveniently located between two of the T-slots 266, such that a remainder of the T-slots 266 remains open and unobstructed for use.

The second wire manager 326 (FIG. 29) includes a single extrusion 341 formed of flexible material. The extrusion 341 forms an enclosed passageway 342, but one side of the extrusion 341 includes overlapping flanges 343 and 344 forming an access slit for inserting wiring 345. A pair of resilient attachment flanges 346 and 347 extend from the extrusion 341, and include oppositely facing barbs 348 and 349 shaped to resiliently engage the blind surfaces on the T-slot 266. Notably, a bottom of the extrusion 314 can be cut to matably receive the tunnel element 100 on the partition 31, if desired.

Shelves 360 (on the rear wall) (FIG. 22) and 361 (on the front post 262), a hanging white board 362, and mini-workstations 363 can also be attached to the T-slots 87, 206, 266, 272, and/or 272'. The shelves 360 and 361 include an L-bracket with anchors, base/disks, and nuts for securement, as do the mini-workstations 363.

It is to be understood that variations and modifications can be made on the aforementioned structure without departing from the concepts of the present invention, and further it is to be understood that such concepts are intended to be covered by the following claims unless these claims by their language expressly state otherwise.

We claim:

1. A furniture system for dividing open office space and the like into individual workstations, comprising:

at least one accessory having an anchor portion thereof adapted to detachably mount said accessory on said furniture system, and an accessory portion thereof configured to equip an associated one of said workstations;

a prefabricated partition panel furniture arrangement including a plurality of individual panels detachably interconnected in a generally side-by-side relationship, and arranged to define at least a portion of one of said workstations; at least one of said panels having a trim member including an outwardly opening attachment slot extending along a substantial portion of the length thereof, with a predetermined configuration to receive the anchor portion of said accessory therein for selectively mounting said accessory at one of a variety of positions along said trim member;

a prefabricated post-and-beam furniture arrangement including a plurality of posts supported on a floor surface of the open office space in a generally vertical orientation and a plurality of beams supported on said posts in a generally horizontal orientation, and arranged on said posts to define at least a portion of one of said workstations; at least one of said beams including an outwardly opening attachment slot extending along a substantial portion of the length thereof, with a predetermined configuration to receive the anchor portion of said accessory therein for selectively mounting said accessory at one of a variety of positions along said one beam; and wherein said predetermined configuration of said attachment slot on said trim member is substantially identical with said predetermined configuration of said attachment slot on said one beam, such that said anchor portion of said accessory can be received within both to detachably mount said accessory either on said trim member or said one beam.

2. A furniture system as set forth in claim 1, wherein:

said predetermined configuration of said attachment slot on said trim member and said one beam has at least one blind surface.

3. A furniture system as set forth in claim 2, wherein:

said anchor portion of said accessory is generally T-shaped to positively yet detachably support said accessory.

4. A furniture system as set forth in claim 3, wherein:

said predetermined configuration of said attachment slot on said trim member and said one beam is generally T-shaped, and sized to closely receive said anchor portion of said accessory therein.

5. A furniture system as set forth in claim 4, wherein:

said accessory includes a plurality of accessories, each having a similarly configured anchor portion to attach to both said trim member and said one beam, and a differently configured accessory portion to variously equip said workstation.

6. A furniture system as set forth in claim 5, wherein:

said one of said beams is supported on said posts at an overhead height.

7. A furniture system as set forth in claim 5, wherein:

said one of said beams is supported on said posts at a height below overhead to define a fence beam.

8. A furniture system as set forth in claim 7, wherein:

at least one of said workstations includes a generally horizontal worksurface supported at a predetermined height; and said fence beam is supported at a height generally commensurate with the predetermined height of said worksurface.

9. A furniture system as set forth in claim 8, wherein:

said fence beam has a generally rectangular lateral cross-sectional configuration defined by a top surface, a bottom surface, and opposite side faces.

10. A furniture system as set forth in claim 9, wherein:

said attachment slot on said one beam extends along one of said side faces of said fence beam.

11. A furniture system as set forth in claim 9, wherein:

said attachment slot on said one beam extends along said top surface of said fence beam.

12. A furniture system as set forth in claim 10, wherein:

said attachment slot on said one beam defines a first attachment slot; and said fence beam includes a second attachment slot extending along said top surface of said fence beam.

13. A furniture system as set forth in claim 12, wherein:

said fence beam includes a third attachment slot extending along said bottom surface of said fence beam.

14. A furniture system as set forth in claim 13, wherein:

said fence beam includes a fourth attachment slot extending along the other one of said side faces of said fence beam.

15. A furniture system as set forth in claim 14, wherein:

said fence beam is at least in part supported by one of said posts having a height below overhead to define a short post.

16. A furniture system as set forth in claim 15, wherein:

said short post has a height slightly above the predetermined height of said worksurface.

17. A furniture system as set forth in claim 16, wherein:

said one of said panels includes a top edge, a bottom edge, and opposite side edges; and said trim member extends along one of said side edges of said one panel.

18. A furniture system as set forth in claim 16, wherein:

said one of said panels includes a top edge, a bottom edge, and opposite side edges; and said trim member extends along said top edge of said one panel.

19. A furniture system as set forth in claim 18, wherein:

said accessories include a slatwall panel.

20. A furniture system as set forth in claim 20, wherein:

said accessories include a writable/erasable board.

21. A furniture system as set forth in claim 20, wherein:

said accessories include a privacy screen.

22. A furniture system as set forth in claim 21, wherein:

said accessories include a retractable door.

23. A furniture system as set forth in claim 22, wherein:

said accessories include a hook.

24. A furniture system as set forth in claim 23, wherein:

said accessories include a shelf.

25. A furniture system as set forth in claim 24, wherein:

said accessories include a worksurface.

26. A furniture system as set forth in claim 25, wherein:

said accessories include a lamp.

27. A furniture system as set forth in claim 26, wherein:

said accessories include a telephone support.

28. A furniture system as set forth in claim 27, wherein:

said accessories include a document holder.

29. A furniture system as set forth in claim 27, wherein:

said accessories include a binder bin.

30. A furniture system as set forth in claim 29, wherein:

at least one of said accessories is supported in a cantilevered fashion.

31. A furniture system as set forth in claim 30, including:

a prefabricated building wall cover arrangement including a plurality of rigid cover sheets configured to be arranged in a generally side-by-side relationship over an associated building wall to cover the same and define at least a portion of one of said workstations, and at least one mounting member extending between said cover sheets, and adapted to support said cover sheets over the building wall; said mounting member including an outwardly opening attachment slot extending along a substantial portion of the length thereof, with a predetermined configuration to receive the anchor portion of one of said accessories therein for selectively mounting said one accessory at one of a variety of positions along said mounting member; and wherein said predetermined configuration of said attachment slot on said mounting member is substantially identical with said predetermined configuration of said attachment slot on said trim member and said beam, such that said anchor portion of said one accessory can be received within each to detachably mount said one accessory either on said mounting member, said trim member or said beam.

32. A furniture system as set forth in claim 31, wherein:

said mounting member is disposed generally vertically between adjacent side edges of said cover sheet.

33. A furniture system as set forth in claim 32, wherein:

said mounting member has a generally T-shaped plan configuration with a flange portion thereof supporting said cover sheets and a web portion thereof captured between adjacent studs in the associated building wall.

34. A furniture system as set forth in claim 33, including:

fasteners attaching the side edges of said cover sheets with said flange portion of said mounting member.

35. A furniture system set forth in claim 34, including:

a cover detachably mounted on said mounting member and covering said fasteners.

36. A furniture system as set forth in claim 35, wherein:

said cover includes a retainer configured for reception in said attachment slot on said mounting member to detachably support said cover on said mounting member.

37. A furniture system as set forth in claim 36, wherein:

said cover sheets comprise drywall sheets.

38. A furniture system as set forth in claim 37, wherein:

a plurality of said panels each include one of said trim member with said attachment slot extending along a substantial portion of the length thereof.

39. A furniture system as set forth in claim 38, wherein:

a plurality of said beams each include said attachment slot extending along a substantial portion of the length thereof.

40. A furniture system as set forth in claim 39, wherein:

a plurality of said posts each include said attachment slot extending along a substantial portion of the length thereof.

41. A furniture system as set forth in claim 1, wherein:

said anchor portion of said accessory is generally T-shaped to positively yet detachably support said accessory.

42. A furniture system as set forth in claim 1, wherein:

said predetermined configuration of said attachment slot on said trim member and said one beam is generally T-shaped, and sized to closely receive said anchor portion of said accessory therein.

43. A furniture system as set forth in claim 1, wherein:

said accessory includes a plurality of accessories, each having a similarly configured anchor portion to attach to both said trim member and said one beam, and a differently configured accessory portion to variously equip said workstation.

44. A furniture system as set forth in claim 1, wherein:

said one beam is supported on said posts at a height below overhead to define a fence beam.

45. A furniture system as set forth in claim 1, wherein:

at least one of said workstations includes a generally horizontal worksurface supported at a predetermined height; and said one beam is supported at a height generally commensurate with the predetermined height of said worksurface.

46. A furniture system as set forth in claim 1, wherein:

said one beam has a generally rectangular lateral cross-sectional configuration defined by a top surface, a bottom surface, and opposite side faces; and said attachment slot on said one beam extends along one of said side faces of said one beam.

47. A furniture system as set forth in claim 46, wherein:

said attachment slot on said one beam defines a first attachment slot; and said one beam includes a second attachment slot extending along said top surface of said one beam.

48. A furniture system as set forth in claim 47, wherein:

said one beam includes a third attachment slot extending along said bottom surface of said one beam.

49. A furniture system as set forth in claim 48, wherein:

said one beam includes a fourth attachment slot extending along the other one of said side faces of said one beam.

50. A furniture system as set forth in claim 1, wherein:

said one beam is at least in part supported by one of said posts having a height below overhead to define a short post.

51. A furniture system as set forth in claim 1, wherein:

said one of said panels includes a top edge, a bottom edge, and opposite side edges; and said trim member extends along one of said side edges of said one panel.

52. A furniture system as set forth in claim 1, wherein:

said one of said panels includes a top edge, a bottom edge, and opposite side edges; and said trim member extends along said top edge of said one panel.

53. A furniture system as set forth in claim 1, wherein:

said accessory comprises one of a slatwall panel, a writable/erasable board, a privacy screen, a retractable door, a hook, a shelf, a worksurface, a lamp, a telephone support, a document holder, and a binder bin.

54. A furniture system as set forth in claim 1, wherein:

said accessory is supported in a cantilevered fashion.

55. A furniture system as set forth in claim 1, including:

a prefabricated building wall cover arrangement including a plurality of rigid cover sheets configured to be arranged in a generally side-by-side relationship over an associated building wall to cover the same and define at least a portion of one of said workstations, and at least one mounting member extending between said cover sheets, and adapted to support said cover sheets over the building wall; said mounting member including an outwardly opening attachment slot extending along a substantial portion of the length thereof, with a predetermined configuration to receive the anchor portion of said accessory therein for selectively mounting said accessory at one of a variety of positions along said mounting member; and wherein said predetermined configuration of said attachment slot on said mounting member is substantially identical with said predetermined configuration of said attachment slot on said trim member and said beam, such that said anchor portion of said accessory can be received within each to detachably mount said accessory either on said mounting member, said trim member or said beam.

56. A furniture system as set forth in claim 1, wherein:

a plurality of said panels each include one of said trim member with said attachment slot extending along a substantial portion of the length thereof.

57. A furniture system as set forth in claim 1, wherein:

a plurality of said beams each include said attachment slot extending along a substantial portion of the length thereof.

58. A furniture system as set forth in claim 1, wherein:

a plurality of said posts each include said attachment slot extending along a substantial portion of the length thereof.

59. A furniture system for dividing open office space and the like into individual workstations, comprising:

at least one accessory having an anchor portion thereof adapted to detachably mount said accessory on said furniture system, and an accessory portion thereof configured to equip an associated one of said workstations;

a prefabricated partition panel furniture arrangement including a plurality of individual panels detachably interconnected in a generally side-by-side relationship, and arranged to define at least a portion of one of said workstations; at least one of said panels having a trim member including an outwardly opening attachment slot extending along a substantial portion of the length thereof, with a predetermined configuration to receive the anchor portion of said accessory therein for selectively mounting said accessory at one of a variety of positions along said trim member;

a prefabricated post-and-beam furniture arrangement including a plurality of posts supported on a floor surface of the open office space in a generally vertical orientation and a plurality of beams supported on said posts in a generally horizontal orientation, and arranged on said posts to define at least a portion of one of said workstations; at least one of said posts including an outwardly opening attachment slot extending along a substantial portion of the length thereof, with a predetermined configuration to receive the anchor portion of said accessory therein for selectively mounting said accessory at one of a variety of positions along said one post; and wherein said predetermined configuration of said attachment slot on said trim member is substantially identical with said predetermined configuration of said attachment slot on said one post, such that said anchor portion of said accessory can be received within both to detachably mount said accessory either on said trim member or said one post.

60. A furniture system as set forth in claim 59, wherein:

said anchor portion of said accessory is generally T-shaped to positively yet detachably support said accessory.

61. A furniture system as set forth in claim 59, wherein:

said predetermined configuration of said attachment slot on said trim member and said one post is generally T-shaped, and sized to closely receive said anchor portion of said accessory therein.

62. A furniture system as set forth in claim 59, wherein:

said accessory includes a plurality of accessories, each having a similarly configured anchor portion to attach to both said trim member and said one post, and a differently configured accessory portion to variously equip said workstation.

63. A furniture system as set forth in claim 59, wherein:

said one of said panels includes a top edge, a bottom edge, and opposite side edges; and said trim member extends along said top edge of said one panel.

64. A furniture system as set forth in 63, wherein:

said accessory comprises one of a slatwall panel, a writable/erasable board, a privacy screen, a retractable door, a hook, a shelf, a worksurface, a lamp, a telephone support, a document holder, and a binder bin.

65. A furniture system as set forth in claim 59, wherein:

said accessory is supported in a cantilevered fashion.

66. A furniture system as set or in claim 59, including:

a prefabricated building wall cover arrangement including a plurality of rigid cover sheets configured to be arranged in a generally side-by-side relationship over an associated building wall to cover the same and define at least a portion of one of said workstations, and at least one mounting member extending between said cover sheets, and adapted to support said cover sheets over the building wall; said mounting member including an outwardly opening attachment slot extending along a substantial portion of the length thereof, with a predetermined configuration to receive the anchor portion of said accessory therein for selectively mounting said accessory at one of a variety of positions along said mounting member; and wherein said predetermined configuration of said attachment slot on said mounting member is substantially identical with said predetermined configuration of said attachment slot on said trim member and said beam, such that said anchor portion of said accessory can be received within each to detachably mount said accessory either on said mounting member, said trim member or said beam.

67. A furniture system as set forth in claim 59, wherein:

a plurality of said panels each include one of said trim member with said attachment slot extending along a substantial portion of the length thereof.

68. A furniture system as set forth in claim 59, wherein:

a plurality of said posts each include said attachment slot extending along a substantial portion of the length thereof.

69. A furniture system as set forth in 59, wherein:

a plurality of said beams each include said attachment slot extending along a substantial portion of the length thereof.

70. A furniture system for dividing open office space and the like into individual workstations, comprising:

at least one accessory having an anchor portion thereof adapted to detachably mount said accessory on said furniture system, and an accessory portion thereof configured to equip an associated one of said workstations;

a prefabricated post-and-beam furniture arrangement including a plurality of posts supported on a floor surface of the open office space in a generally vertical orientation and a plurality of beams supported on said posts in a generally horizontal orientation, and arranged on said posts to define at least a portion of one of said workstations; at least one of said beams including an outwardly opening attachment slot extending along a substantial portion of the length thereof, with a predetermined configuration to receive the anchor portion of said accessory therein for selectively mounting said accessory at one of a variety of positions along said one beam;

a prefabricated building wall cover arrangement including a plurality of rigid cover sheets configured to be arranged in a generally side-by-side relationship over an associated building wall to cover the same and define at least a portion of one of said workstations, and at least one mounting member extending between said cover sheets, and adapted to support said cover sheets over the building wall; said mounting member including an outwardly opening attachment slot extending along a substantial portion of the length thereof, with a predetermined configuration to receive the anchor portion of said accessory therein for selectively mounting said accessory at one of a variety of positions along said mounting member; and wherein said predetermined configuration of said attachment slot on said one beam is substantially identical with said predetermined configuration of said attachment slot on said mounting member, such that said anchor portion of said accessory can be received within each to detachably mount said accessory either on said one beam or said mounting member.

71. A furniture system as set forth in claim 70, wherein:

said anchor portion of said accessory is generally T-shaped to positively yet detachably support said accessory.

72. A furniture system as set forth in claim 70, wherein:

said predetermined configuration of said attachment slot on said trim member and said one beam is generally T-shaped, and sized to closely receive said anchor portion of said accessory therein.

73. A furniture system as set forth in claim 70, wherein:

said accessory includes a plurality of accessories, each having a similarly configured anchor portion to attach to both said trim member and said one beam, and a differently configured accessory portion to variously equip said workstation.

74. A furniture system as set forth in claim 70, wherein:

said one beam is supported on said posts at a height below overhead to define a fence beam.

75. A furniture system as set forth in claim 70, wherein:

at least one of said workstations includes a generally horizontal worksurface supported at a predetermined height; and said one beam is supported at a height generally commensurate with the predetermined height of said worksurface.

76. A furniture system as set forth in claim 70, wherein:

said one beam has a generally rectangular lateral cross-sectional configuration defined by a top surface, a bottom surface, and opposite side faces; and said attachment slot on said one beam extends along one of said side faces of said one beam.

77. A furniture system as set forth in claim 70, wherein:

said accessory comprises one of a slatwall panel, a writable/erasable board, a privacy screen, a retractable door, a hook, a shelf, a worksurface, a lamp, a telephone support, a document holder, and a binder bin.

78. A furniture system as set forth in claim 70, wherein:

said mounting member is disposed generally vertically between adjacent side edges of said cover sheet.

79. A furniture system as set forth in claim 78, wherein:

said mounting member has a generally T-shaped plan configuration with a flange portion thereof supporting said cover sheets and a web portion thereof captured between adjacent studs in the associated building wall.

80. A furniture system as set forth in claim 79, including:

fasteners attaching the side edges of said cover sheets with said flange portion of said mounting member.

81. A furniture system as set forth in claim 80, including:

a cover detachably mounted on said mounting member and covering said fasteners.

82. A furniture system as set forth in claim 81, wherein:

said cover includes a retainer configured for reception in said attachment slot on said mounting member to detachably support said cover on said mounting member.

83. A furniture system as set forth in claim 82, wherein:

said cover sheets comprise drywall sheets.

84. A furniture system for dividing open office space and the like into individual workstations, comprising:

at least one accessory having an anchor portion thereof adapted to detachably mount said accessory on said furniture system, and an accessory portion thereof configured to equip an associated one of said workstations;

a prefabricated post-and-beam furniture arrangement including a plurality of posts supported on a floor surface of the open office space in a generally vertical orientation and a plurality of beams supported on said posts in a generally horizontal orientation, and arranged on said posts to define at least a portion of one of said workstations; at least one of said posts including an outwardly opening attachment slot extending along a substantial portion of the length thereof, with a predetermined configuration to receive the anchor portion of said accessory therein for selectively mounting said accessory at one of a variety of positions along said one post;

a prefabricated building wall cover arrangement including a plurality of rigid cover sheets configured to be arranged in a generally side-by-side relationship over an associated building wall to cover the same and define at least a portion of one of said workstations, and at least one mounting member extending between said cover sheets, and adapted to support said cover sheets over the building wall; said mounting member including an outwardly opening attachment slot extending along a substantial portion of the length thereof, with a predetermined configuration to receive the anchor portion of said accessory therein for selectively mounting said accessory at one of a variety of positions along said mounting member; and wherein said predetermined configuration of said attachment slot on said one post is substantially identical with said predetermined configuration of said attachment slot on said mounting member, such that said anchor portion of said accessory can be received within each to detachably mount said accessory either on said one post or said mounting member.

85. A furniture system for dividing open office space and the like into individual workstations, comprising:

at least one accessory having an anchor portion thereof adapted to detachably mount said accessory on said furniture system, and an accessory portion thereof configured to equip an associated one of said workstations;

a prefabricated partition panel furniture arrangement including a plurality of individual panels detachably interconnected in a generally side-by-side relationship, and arranged to define at least a portion of one of said workstations; at least one of said panels having a trim member including an outwardly opening attachment slot extending along a substantial portion of the length thereof, with a predetermined configuration to receive the anchor portion of said accessory therein for selectively mounting said accessory at one of a variety of positions along said trim member;

a prefabricated building wall cover arrangement including a plurality of rigid cover sheets configured to be arranged in a generally side-by-side relationship over an associated building wall to cover the same and define at lest a portion of one of said workstations, and at least one mounting member extending between said cover sheets, and adapted to support said cover sheets over the building wall; said mounting member including an outwardly opening attachment slot extending along a substantial portion of the length thereof, with a predetermined configuration to receive the anchor portion of said accessory therein for selectively mounting said accessory at one of a variety of positions along said mounting member; and wherein said predetermined configuration of said attachment slot on said trim member is substantially identical with said predetermined configuration of said attachment slot on said mounting member, such that said anchor portion of said accessory can be received within each to detachably mount said accessory either on said trim member or said mounting member.

86. A furniture system for dividing open office space and the like into individual workstations, comprising:

at least one accessory having an anchor portion thereof adapted to detachably mount said accessory on said furniture system, and an accessory portion thereof configured to equip an associated one of said workstations;

a prefabricated partition panel furniture arrangement including a plurality of individual panels detachably interconnected in a generally side-by-side relationship, and arranged to define at least a portion of one of said workstations; at least one of said panels having a trim member including a first accessory mount extending along a substantial portion of the length thereof, with a predetermined configuration to mate with the anchor portion of said accessory for selectively mounting said accessory at one of a variety of positions along said trim member;

a prefabricated post-and-beam furniture arrangement including a plurality of posts supported on a floor surface of the open office space in a generally vertical orientation and a plurality of beams supported on said posts in a generally horizontal orientation, and arranged on said posts to define at least a portion of one of said workstations; at least one of said beams including a second accessory mount extending along a substantial portion of the length thereof, with a predetermined configuration to mate with the anchor portion of said accessory for selectively mounting said accessory at one of a variety of positions along said one beam; and wherein said predetermined configuration of said first accessory mount on said trim member is substantially identical with said predetermined configuration of said second accessory mount on said one beam, such that said anchor portion of said accessory can be mated with both to detachably mount said accessory either on said trim member or said one beam.

87. A furniture system as set forth in claim 86, wherein:

at least one of said posts includes at least one said second accessory mount extending along a substantial portion of die length thereof for selectively mounting said accessory at one of a variety of positions along said one post.

88. A furniture system as set forth in claim 87, including:

a prefabricated building wall cover arrangement including a plurality of rigid cover sheets configured to be arranged in a generally side-by-side relationship over an associated building wall to cover the same and define at least a portion of one of said workstations, and at least one mounting member extending between said cover sheets, and adapted to support said cover sheets over the building wall; said mounting member including a third accessory mount extending along a substantial portion of the length thereof, with a predetermined configuration to mate with the anchor portion of said accessory for selectively mounting said accessory at one of a variety of positions along said mounting member; and wherein said predetermined configuration of said third accessory mount on said mounting member is substantially identical with said predetermined configuration of said first accessory mount on said trim member and said second accessory mount on said beam, such that said anchor portion of said accessory can be mated with each to detachably mount said accessory either on said mounting member, said trim member or said beam.

89. A furniture system as set forth in claim 88, wherein:

a plurality of said panels each include at least one of said trim member with said first accessory mount extending along a substantial portion of the length thereof.

90. A furniture system as set forth in claim 89, wherein:

a plurality of said beams each include said second accessory mount extending along a substantial portion of the length thereof.

91. A furniture system as set forth in claim 90, wherein:

a plurality of said posts each include said second accessory mount extending along a substantial portion of the length thereof.

92. A furniture system as set forth in claim 91, wherein:

a plurality of said mounting members each including said third accessory mount extending along a substantial portion of the length thereof.

93. A furniture system as set forth in claim 92, wherein:

said accessory includes a plurality of accessories, each having a similarly configured anchor portion to attach to both said trim member, said one beam, said one post, and said mounting member and a differently configured accessory portion to variously equip said workstations.

94. A furniture system as set forth in claim 93, wherein:

said accessory comprises one of a slatwall panel, a writable/erasable board, a privacy screen, a retractable door, a hook, a shelf, a worksurface, a lamp, a telephone support, a document holder, and a binder bin.

95. A furniture system for dividing open office space and the like into individual workstations, comprising:

at least one accessory having an anchor portion thereof adapted to detachably mount said accessory on said furniture system, and an accessory portion thereof configured to equip an associated one of said workstations;

a prefabricated partition panel furniture arrangement including a plurality of individual panels detachably interconnected in a generally side-by-side relationship, and arranged to define at least a portion of one of said workstations; at least one of said panels having a trim member including a first accessory mount extending along a substantial portion of the length thereof, with a predetermined configuration to mate with the anchor portion of said accessory for selectively mounting said accessory at one of a variety of positions along said trim member;

a prefabricated post-and-beam furniture arrangement including a plurality of posts supported on a floor surface of the open office space in a generally vertical orientation and a plurality of beams supported on said posts in a generally horizontal orientation, and arranged on said posts to define at least a portion of one of said workstations; at least one of said posts including a second accessory mount extending along a substantial portion of the length thereof, with a predetermined configuration to mate with the anchor portion of said accessory for selectively mounting said accessory at one of a variety of positions along said one post; and wherein said predetermined configuration of said first accessory mount on said trim member is substantially identical with said predetermined configuration of said second accessory mount on said one post, such that said anchor portion of said accessory can be mated with both to detachably mount said accessory either on said trim member or said one post.

* * * * *

UNITED STATES PATENT AND TRADEMARK OFFICE

CERTIFICATE OF CORRECTION

PATENT NO. : 6,807,776 B2
DATED : October 26, 2004
INVENTOR(S) : David M. Gresham et al.

It is certified that error appears in the above-identified patent and that said Letters Patent is hereby corrected as shown below:

Title page,
Item [12], "Girdwood et al." should be -- Gresham et al. --.
Item [75], Inventors, "Daniel L. Girdwood" should be -- David M. Gresham --.

Column 2,
Line 44, "include" should be -- includes --.

Column 3,
Line 9, "mateably" should be -- matably --.

Column 4,
Line 41, after "shown" insert -- in --.
Line 45, "XXIXa-XXIVa" should be -- XXIVa-XXIVa --.

Column 5,
Lines 63-64, delete "(filed same day as present application)".

Column 7,
Lines 13 and 39, "cross sectional" should be -- cross-sectional --.

Column 8,
Lines 2-3, "cross sectional" should be -- cross-sectional --.
Line 8, "cut-out" should be -- cutout --.
Line 8, "mateably" should be -- matably --.

Column 10,
Line 30, "208s" should be -- 208 --.
Line 32, before "both" delete "the".

Column 11,
Lines 34 and 40, "Mar. 6, 2002" should be -- Mar. 6, 2001 --.
Line 45, "09/694,646" should be -- 09/694,296 --.

Column 15,
Line 55, "claim 20" should be -- claim 19 --.

Column 19,
Line 30, before "63" insert -- claim --.
Line 37, "or" should be -- forth --.

UNITED STATES PATENT AND TRADEMARK OFFICE

CERTIFICATE OF CORRECTION

PATENT NO. : 6,807,776 B2
DATED : October 26, 2004
INVENTOR(S) : David M. Gresham et al.

It is certified that error appears in the above-identified patent and that said Letters Patent is hereby corrected as shown below:

Column 20,
Line 1, before "59" insert -- claim --.

Column 22,
Line 35, "lest" should be -- least --.

Column 23,
Line 27, "die" should be -- the --.

Signed and Sealed this

Nineteenth Day of April, 2005

JON W. DUDAS
*Director of the United States Patent and Trademark Office*